US010060177B2

(12) United States Patent
Smith

(10) Patent No.: US 10,060,177 B2
(45) Date of Patent: Aug. 28, 2018

(54) GUN SAFE

(71) Applicant: Carl P Smith, Allerton, IL (US)

(72) Inventor: Carl P Smith, Allerton, IL (US)

( * ) Notice: Subject to any disclaimer, the term of this patent is extended or adjusted under 35 U.S.C. 154(b) by 0 days.

(21) Appl. No.: 15/344,481

(22) Filed: Nov. 4, 2016

(65) Prior Publication Data

US 2017/0130513 A1 May 11, 2017

Related U.S. Application Data

(60) Provisional application No. 62/251,862, filed on Nov. 6, 2015, provisional application No. 62/296,318, filed on Feb. 17, 2016.

(51) Int. Cl.

| | |
|---|---|
| ***E05G 1/026*** | (2006.01) |
| ***E05G 1/024*** | (2006.01) |
| ***E05G 1/04*** | (2006.01) |
| ***F41C 33/06*** | (2006.01) |
| ***A47B 81/00*** | (2006.01) |
| ***E05G 1/00*** | (2006.01) |

(52) U.S. Cl.

CPC ..... *E05G 1/026* (2013.01); *A47B 81/00* (2013.01); *A47B 81/002* (2013.01); *A47B 81/005* (2013.01); *E05G 1/00* (2013.01); *E05G 1/024* (2013.01); *E05G 1/04* (2013.01); *F41C 33/06* (2013.01); *E05Y 2800/26* (2013.01); *E05Y 2800/416* (2013.01)

(58) Field of Classification Search

CPC .. E05G 1/00; E05G 1/02; E05G 1/024; E05G 1/026; A47B 81/00; A47B 81/002; A47B 81/005; A47B 81/007

See application file for complete search history.

(56) References Cited

U.S. PATENT DOCUMENTS

| | | | | |
|---|---|---|---|---|
| 3,330,612 A | | 7/1967 | Masterson et al. | |
| 3,731,818 A | * | 5/1973 | Young | A47B 81/005 206/317 |
| 4,383,721 A | | 5/1983 | Knaack et al. | |
| 5,056,342 A | * | 10/1991 | Prinz | A47C 21/00 109/51 |
| 6,033,046 A | * | 3/2000 | Lambright | E06B 5/006 312/295 |

(Continued)

OTHER PUBLICATIONS

Liberty Safe, Safe Catalog 2016, REV. Jan. 4, 2016, p. 32, Liberty Safe and Security Products, Inc. (http://www.libertysafe.com/images/downloads/safe-catalog.pdf).

*Primary Examiner* — Christopher J Boswell
(74) *Attorney, Agent, or Firm* — Wendy Thai

(57) ABSTRACT

The invention provides a modified box-shape safe that includes a cabinet having an open front contiguous with an open oblique side obtusely angled relative to the open front. The safe cabinet is formed by two vertically oriented rectangular sections that adjoin to form the cabinet's back and side wall and two horizontally oriented trapezoidal sections that adjoin adjacent horizontal edges of the back and side walls to form the cabinet's top and bottom. The open front and contiguous open oblique side of the cabinet is closed using a safe door having a rectangular front section adjoining an oblique side section obtusely angled relative tot the front section. The door is pivotably connected to the cabinet so as to open from the oblique side section.

22 Claims, 14 Drawing Sheets

(56) References Cited

U.S. PATENT DOCUMENTS

| | | | | |
|---|---|---|---|---|
| 6,405,861 | B1 * | 6/2002 | Siler | F41C 33/06 206/1.5 |
| 6,865,993 | B2 * | 3/2005 | Bartel | E05D 15/56 109/48 |
| 8,474,923 | B2 * | 7/2013 | Pendleton | A47B 81/005 109/48 |
| 8,997,994 | B1 * | 4/2015 | Jung | A47B 81/00 206/541 |
| 9,278,649 | B2 * | 3/2016 | McGoldrick | B60R 7/14 |
| 2003/0041787 | A1 * | 3/2003 | Gerstenkorn | A47B 81/005 109/73 |
| 2008/0203860 | A1 * | 8/2008 | Myers | A47B 81/005 312/204 |
| 2010/0282136 | A1 * | 11/2010 | Stanley | E05G 1/005 109/64 |

* cited by examiner

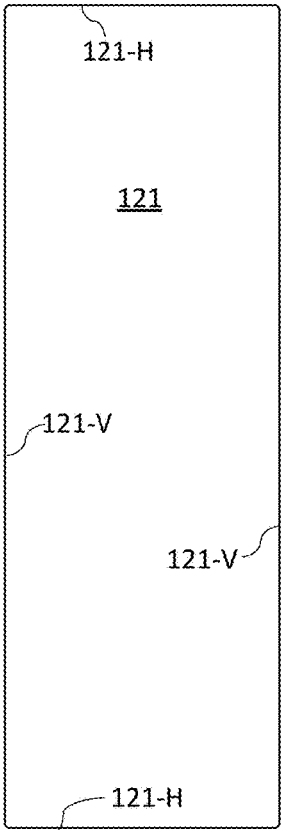
Fig. 1D
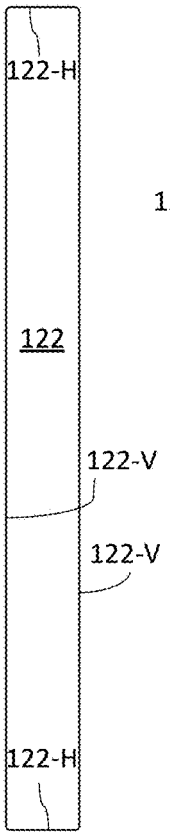
Fig. 1E
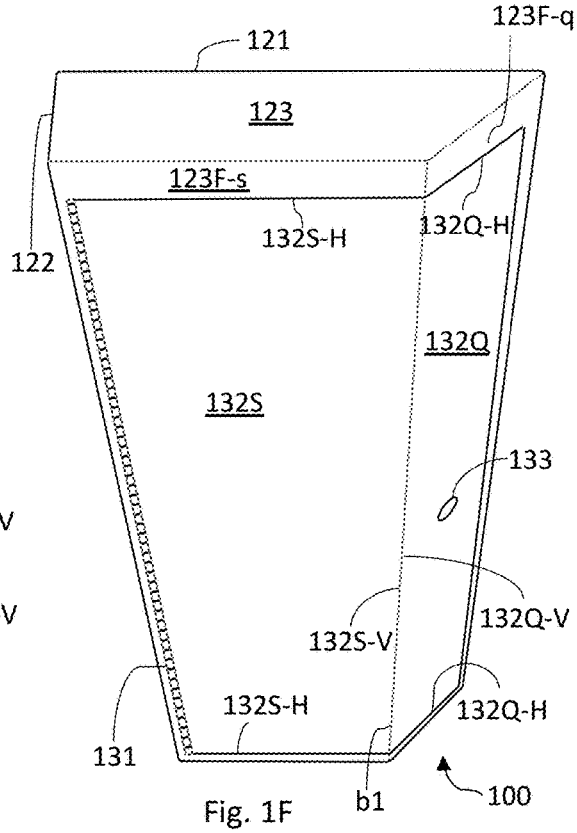
Fig. 1F
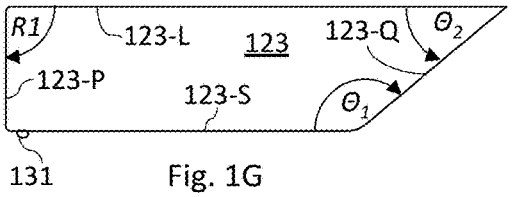
Fig. 1G
Fig. 1H
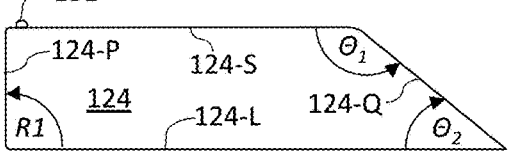

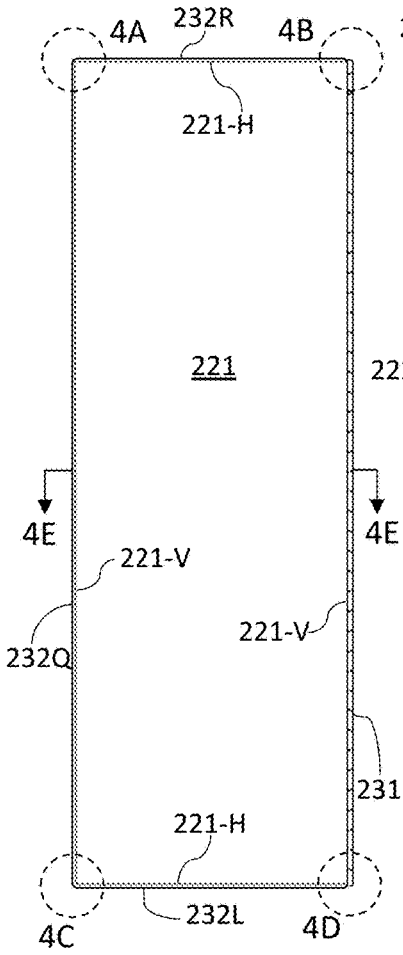
Fig. 3D
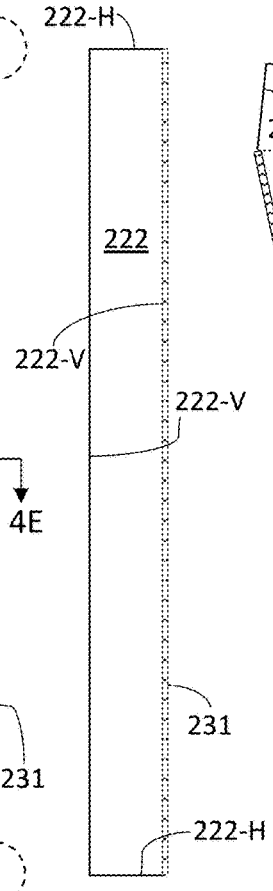
Fig. 3E
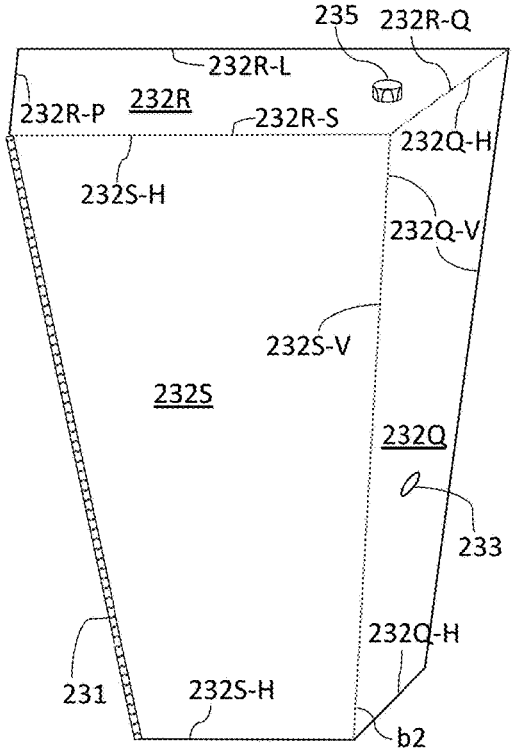
Fig. 3F
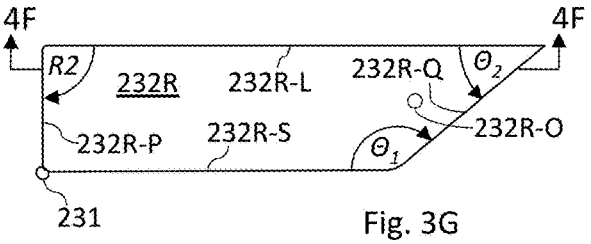
Fig. 3G
Fig. 3H
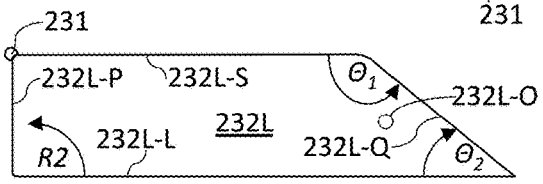

Fig. 4A
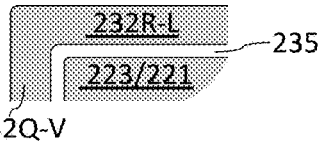
Fig. 4B
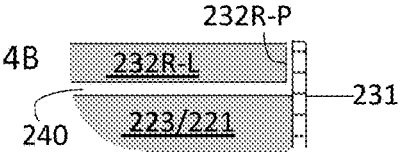
Fig. 4C
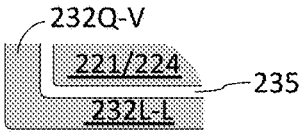
Fig. 4D
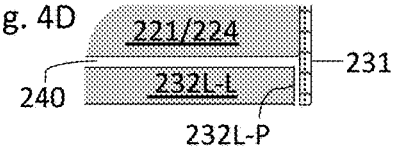
Fig. 4E
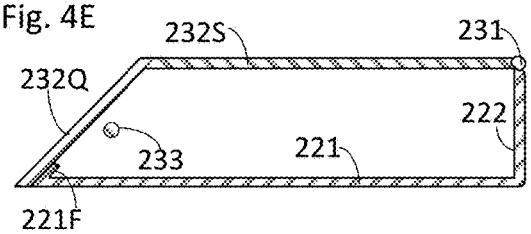
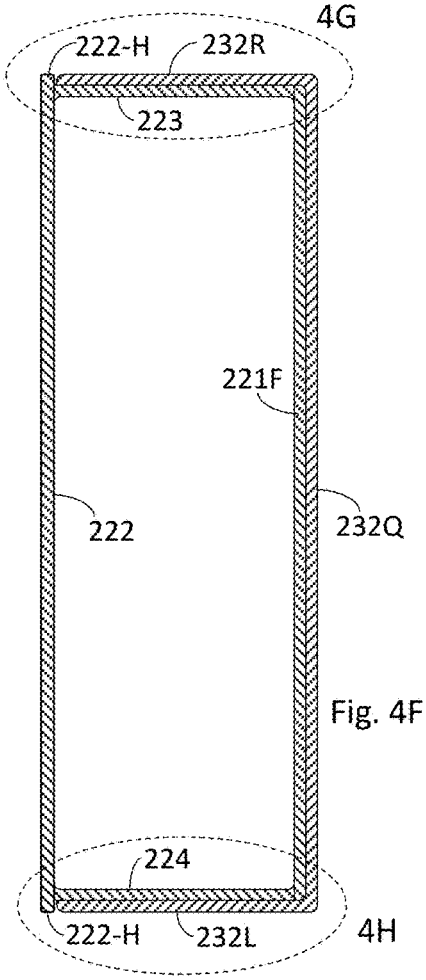
Fig. 4F
Fig. 4G
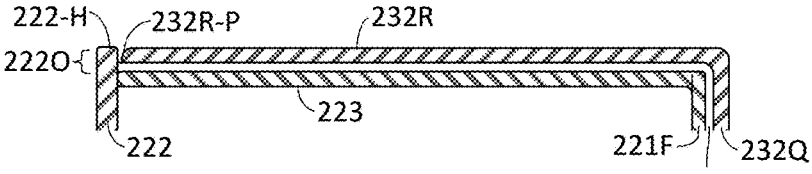
Fig. 4H
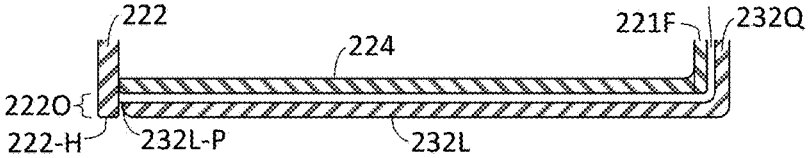

Fig. 5A
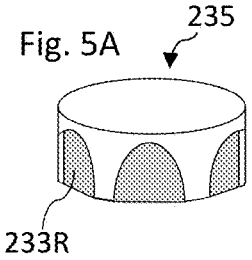
Fig. 5B
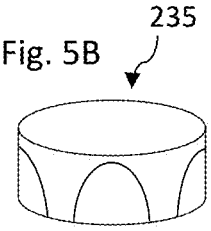
Fig. 5C
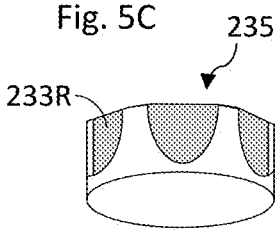
Fig. 5D
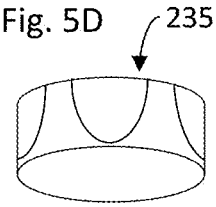
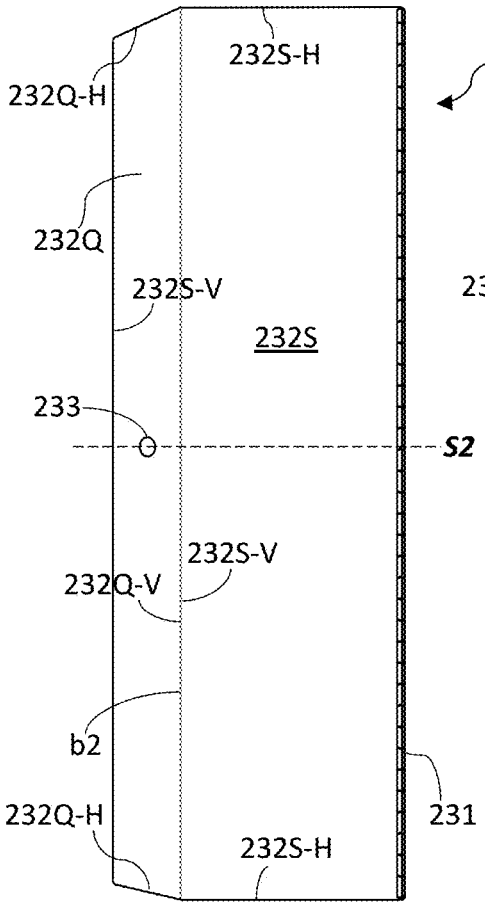
Fig. 6A
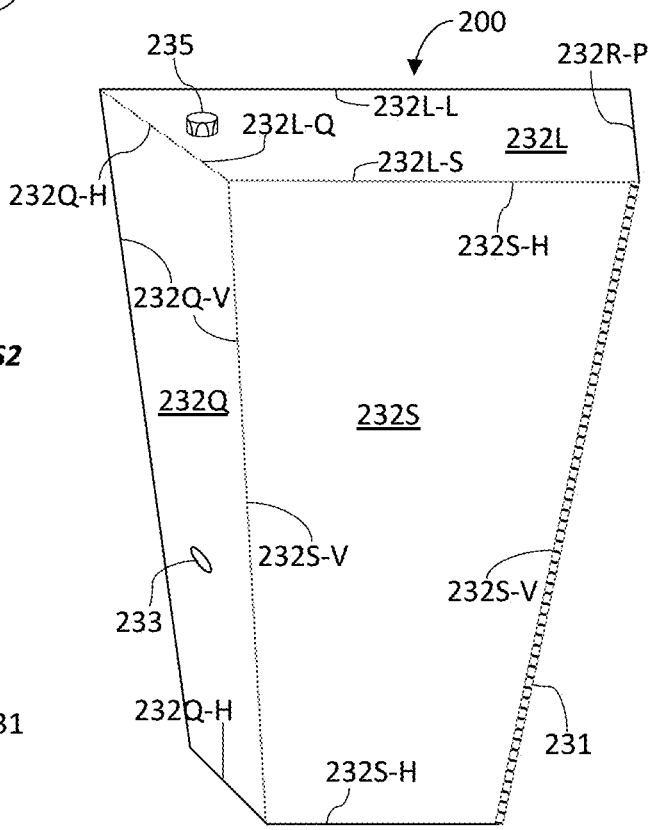
Fig. 6B Fig. 7F
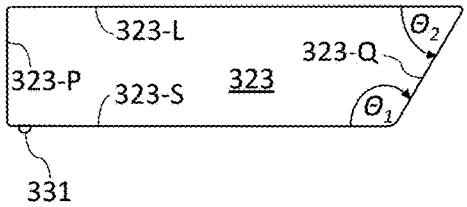
Fig. 7H
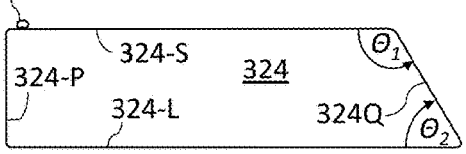
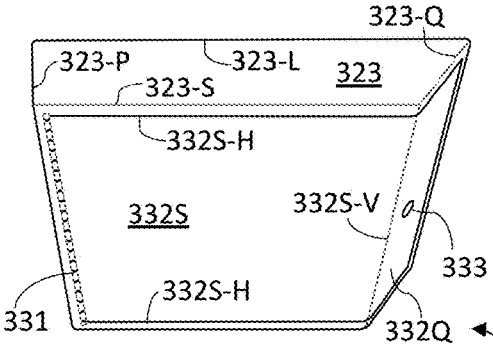
Fig. 7G
Fig. 7I
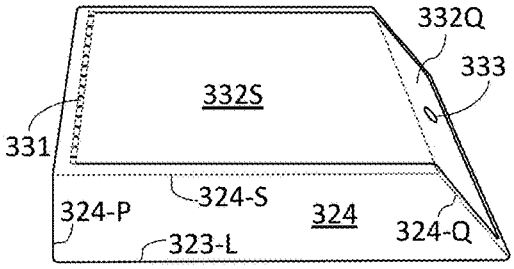
300
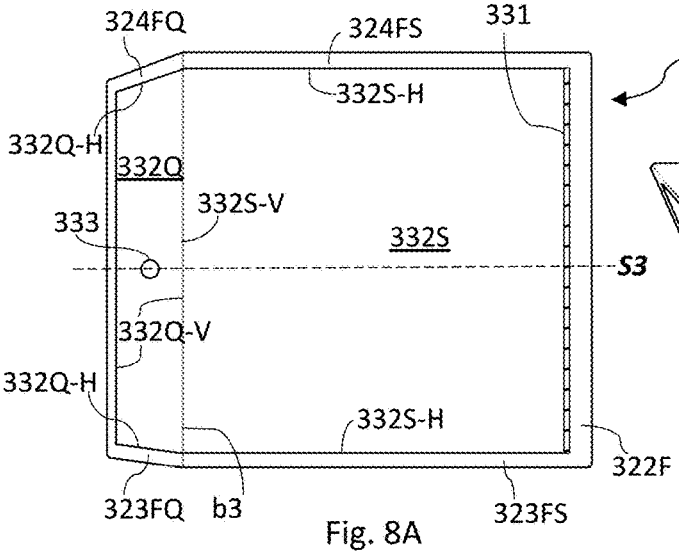
Fig. 8A
300
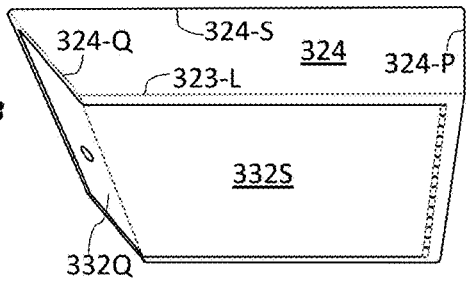
Fig. 8B

400

400

GUN SAFE

CROSS-REFERENCE TO RELATED APPLICATIONS

This application claims priority to U.S. Provisional Patent Application No. 62/251,862 filed Nov. 6, 2015, and U.S. Provisional Patent Application No. 62/296,318, filed Feb. 17, 2016, the contents of which are incorporated herein by reference in their entirety.

BACKGROUND

A safe is a strong, usually fireproof cabinet with a complex lock used for storing items such as important documents and valuable articles to limit access or to protect against theft or damage from fire. It is generally a free standing or wall mounted cabinet having a top, a bottom, a back and two sides that adjoin at right angles to form a box-shaped enclosure with a hollow interior and a front opening. A hinged door occupying the front opening of the safe cabinet forms the front façade of the safe and a barrier to the interior of the cabinet when closed and secured in position by a lock. For unobstructed access the interior of the safe, the user stands in front of the safe cabinet and access the interior of the safe through the front opening by unlocking and swinging the door open to a position generally perpendicular to the opening of the safe cabinet. As such, a conventional free standing or wall-mounted safe with its dedicated top, bottom, sides, and a hinged door at the front of the safe that pivots open to enable access to the interior of the safe is useful where space is plenty for opening and closing the door.

SUMMARY OF THE INVENTION

The invention provides an improved safe that can be used in narrow spaces. A safe of the invention includes a cabinet with an open front contiguous with an open oblique side obtusely angled relative to the open front, and a door having a front section and an oblique side section obtusely angled relative to the front section. The door is configured to close the open front and open oblique side of the cabinet. A hinge pivotably connects the door to the cabinet and allows the door to open from the oblique side. As such, the user can access the inside of the safe cabinet by reaching in through the open oblique side of the cabinet when the door is partly open. A safe of the invention can be disposed adjacent a door so as to occupy the space between a wall and a perpendicularly opened door, the open oblique side of the safe cabinet enabling the user to reach behind the opened door and access the interior of the safe when positioned beside the safe adjacent the open door.

In one aspect, the invention provides modified box-shape safe comprising an oblique side having: (a) a modified box-shaped cabinet for holding an article that includes a rectangular back wall, a rectangular side wall, and congruent trapezoidal top and bottom walls defining an open front and contiguous open oblique side obtusely angled relative to the open front; and (b) a door that having a rectangular front section adjoining a rectangular oblique side section obtusely angled relative to the front section, the door being configured to close the open front and contiguous open oblique side of the cabinet to form a closed chamber; the door being hinged to the cabinet so as to enable the door to open from the oblique side.

In some embodiments, the rectangular side wall of the safe has a first vertical edge that perpendicularly adjoins a vertical edge of the back wall thereby forming an orthogonal side wall, and the trapezoidal top and bottom wall each has a longer and a shorter parallel edge, an orthogonal edge extending perpendicularly between the parallel edges on one side, and an oblique edge extending obliquely between the parallel edges on the other side, the longer parallel edge and orthogonal edge perpendicularly adjoining a horizontal edge of the back wall and an adjacent horizontal edge of the orthogonal side wall, respectively.

In some embodiments, the front section of the door is wider than the oblique side section of the door.

In some embodiments, the front section of the door adjoins the oblique side section of the door at an angle between about 120 degrees to about 150 degrees.

In some embodiments, the orthogonal side wall is about 2 inches to about 7 inches wide.

In some embodiments, the back wall of the safe has vertical and horizontal edges of the same lengths thereby forming a square back wall. In other embodiments, the back wall of the safe has vertical edges with greater lengths than the lengths of the horizontal edges thereby forming a safe that is taller than it is wide. In yet other embodiments, the back wall has vertical edges of shorter lengths than the lengths of the horizontal edges thereby forming a safe that is wider than it is tall.

In some embodiments of a safe of the invention, the cabinet has a face frame surrounding the open front and contiguous open oblique side of the cabinet, the face frame having: (a) a first and a second horizontal frame member, each with a front portion that perpendicularly adjoins the shorter parallel edge of the trapezoidal top and bottom wall and an oblique portion that perpendicularly adjoins the oblique edge of the trapezoidal top and bottom wall; and (b) a first and a second vertical frame member that perpendicularly adjoin a vertical edge of the back wall and orthogonal side wall, respectively.

In some embodiments, the cabinet also has two horizontally oriented inner lock flanges, each perpendicularly adjoining at least the oblique portion of one of the horizontal frame members, and the safe door has two horizontally oriented inner lock flanges, each perpendicularly adjoining a horizontal edge of at least the oblique side of the door, one door lock flange extending beneath one of the two cabinet lock flanges to form the top lock flanges, and the other door lock flange overlaying the other of the two cabinet lock flanges to form the bottom lock flanges when the door is closed. In these embodiment, the top and bottom lock flanges each include a lock opening disposed adjacent the oblique side of the cabinet and door, respectively. In these embodiments, the lock openings on the top lock flanges are vertically aligned to receive a lock rod extending through the aligned lock openings at the top, and the lock openings on the bottom lock flanges are vertically aligned to receive second lock rod extending through the aligned lock openings at the bottom when the door is closed.

In some embodiments, the door is hinged to the vertical frame member that adjoins the orthogonal side wall of the cabinet.

In some embodiments, the door further includes a top and a bottom section, each horizontally oriented to extend over the top or under the bottom of at least a portion of the top or bottom wall of the cabinet when the door is pivoted to close the cabinet.

In some embodiments, each of the top and bottom sections of the door is a congruent right trapezoidal sections substantially similar to the trapezoidal top and bottom wall of the cabinet, each trapezoidal section of the door having a longer and a shorter parallel edge, an orthogonal edge extending perpendicularly between the parallel edges, and an oblique edge extending between the parallel edges and obtusely angled relative to the shorter parallel edge, wherein the shorter parallel edge and the oblique edge of each trapezoidal door section perpendicularly adjoin adjacent horizontal edges of the front section and oblique side section of the door, respectively.

In some embodiments, each of the trapezoidal top and bottom wall of the cabinet perpendicularly adjoins the orthogonal side wall of the cabinet at a position off set from a horizontal edge of the orthogonal side wall so as to form a top and bottom orthogonal side overhang enabling the top and bottom trapezoidal door sections to lay flush against the orthogonal side wall of the safe when the door is closed.

In some embodiments, each of the trapezoidal top and bottom wall of the cabinet and each of the trapezoidal top and bottom section of the door has a lock opening size to accommodate a lock rod for securing the door to the cabinet. The lock opening on the top wall of the cabinet and the lock opening on the top section of the door are vertically aligned when the door is closed so as to accommodate a first lock rod extending through the aligned lock openings at the top. The lock opening on the bottom wall of the cabinet and the lock opening on the bottom section of the door are vertically aligned when the door is closed so as to accommodate a second lock rod extending through the aligned lock openings at the bottom.

In some embodiments, the trapezoidal top or bottom section of the door has a lock cap having a hollow interior configured to accommodate a portion of the lock rod extending through the aligned lock openings. The lock cap has one or more lateral openings through which the presence of the lock rod extending through the aligned lock opening can be seen.

In some embodiments, the safe has a two- or three-point lock assembly having two vertically oriented lock rods configured to move vertically in opposite directions through operation of the lock assembly.

In some embodiments, the back wall of the cabinet has one or more openings through which the safe is mounted to a wall.

In some embodiments, the cabinet back wall, side wall, trapezoidal top wall, trapezoidal bottom wall, safe door, or any combination thereof is made of steel.

In some embodiments, the door is hinged to the cabinet through a continuous hinge.

As used herein, the term "obtuse" or "obtusely" in reference to an angle means greater than 90 degrees and less than 180 degrees. The term "acute" or "acutely" in reference to an angle means less than 90 degrees and greater than 0 degrees.

As used herein, the term "perpendicular" or "perpendicularly" means at right angle or about 90 degrees. As used herein, the term "about" means within 10% of a recited value. A value is within 10% of a recited value if the value is between 90% and 110% of the recited value.

As used herein, the term "vertical" or "vertically" means at right angle to or about 90 degrees to the horizontal, and the term "horizontal" or "horizontally" means parallel to the plane of the horizon.

The term "vertically oriented" or "horizontally oriented," as used in reference to a structural component such as the back wall, side wall, top wall or bottom wall of the safe, refers to the position or orientation of the largest surface. A cabinet wall or door section is vertically oriented if its largest surface is in a vertical position and horizontally oriented if its largest surface is in a horizontal position. The back wall is vertically oriented as it is positioned so its largest surface is in a vertical position. The trapezoidal top or bottom of the safe cabinet is horizontally oriented as each is positioned so its largest surface is in a horizontal position.

The term "rectangular," "square," or "trapezoidal," as used in reference to a three-dimensional structural component of the safe, refers to the shape of the largest surface of the component. A back wall of the safe is rectangular as its largest surface has a rectangular shape. A back wall is square where its largest surface has a square shape. The top or bottom wall of the safe cabinet is trapezoidal as its largest surface has a trapezoidal shape. A rectangular, square or trapezoidal component can have a thickness defined by its shortest edge.

As used herein, the term "rectangular" refers to a shape defined by four edges in which adjacent edges are perpendicular and opposite edges are parallel. The term "rectangular," as used in reference to a cabinet wall or door section, includes a wall or section that is wider than it is tall, taller than it is wide, or square shape (as tall as it is wide).

As used herein, the term "trapezoid" or "trapezoidal" refers to a shape defined by four edges in which at least one set of opposite edges are parallel. The term "trapezoidal," as used in reference to the shape of a top or bottom cabinet wall or door section or in reference to the shape of the cross-section or footprint of a safe of the invention, refers to a shape that has a pair of opposite parallel edges of equal or unequal lengths, a perpendicular or non-perpendicular edge extending between the opposite parallel edges on one side, and an oblique edge extending between the two opposite parallel edges on the other side. The term "trapezoid" or "trapezoidal" includes a right trapezoidal shape in which one side edge is perpendicular to the parallel edges, a trapezoidal shape in which both side edges are similarly oblique, i.e. similarly angled with respect to the same parallel edge so as to form a parallelogram in which both sets of opposite sides are parallel, or a trapezoidal shape in which the side edges are not similarly oblique, i.e., the side edges are not similarly angled with respect to the same parallel edge.

Any feature or combination of features described herein are included within the scope of the present invention provided that the features included in any such combination are not mutually inconsistent as will be apparent from the context, this specification and the knowledge of one of ordinary skill in the art.

Unless otherwise defined, all technical and scientific terms used herein have the same meaning as commonly understood by one of ordinary skill in the art to which this invention belongs. In case of conflict, the present specification, including definitions, will control. In addition, the materials, methods, and examples are illustrative only and not intended to be limiting. Although methods and materials similar or equivalent to those described herein can be used to practice the invention, suitable methods and materials are described below.

All patents and publications referenced or mentioned herein are indicative of the levels of skill of those skilled in the art to which the invention pertains, and each such referenced patent or publication is hereby incorporated by reference to the same extent as if it had been incorporated by reference in its entirety individually or set forth herein in its entirety. Applicants reserve the right to physically incorporate into this specification any and all materials and information from any such cited patents or publications.

Other features and advantages of the invention will be apparent from the following detailed description and from the claims.

BRIEF DESCRIPTION OF THE FIGURES

FIGS. 1A-1H are views of a first embodiment of a safe of the invention including: a front side view (FIG. 1A), a right side view (FIG. 1B), a right perspective view (FIG. 1C), a rear side view (FIG. 1D), a left side view (FIG. 1E), a top perspective view from the front (FIG. 1F), a top side view (FIG. 1G), and a bottom side view (FIG. 1H) of safe 100.

FIGS. 3A-3H are views of a second embodiment of a safe of the invention including: a front side view (FIG. 3A), a right side view (FIG. 3B), a right perspective view (FIG. 3C), a rear side view (FIG. 3D), a left side view (FIG. 3E), a top perspective view from the front (FIG. 3F), a top side view (FIG. 3G), and a bottom side view (FIG. 3H) of safe 200.

FIGS. 4A-4H are various cross-sectional and enlarged views of safe 200 including: an expanded view of the upper left rear corner 4A of safe 200 shown in FIG. 3D (FIG. 4A), upper right corner 4B shown in FIG. 3D (FIG. 4B), lower left rear corner 4C shown in FIG. 3D (FIG. 4C); lower right rear corner 4D shown in FIG. 3D (FIG. 4D); horizontal cross-sectional view along line 4E-4E shown in FIG. 3A (FIG. 4E), vertical cross-sectional view along line 4F-4F shown in FIG. 3G (FIG. 4F), expanded view of portion 4G of FIG. 4F (FIG. 4G), and expanded view of portion 4H of FIG. 4G (FIG. 4H).

FIGS. 5A-5D are perspective views of lock cap 235 including a perspective views of lock cap 235 in which lock rod 504 is visible when the safe is in a locked position (FIG. 5A) or not visible when safe is in an unlocked position (FIG. 5B), and perspective views of lock cap 235 in which lock rod 233R is visible when safe is in locked position (FIG. 5C) or not visible when safe is in an unlocked position (FIG. 5D).

FIGS. 6A-6B are views of safe 200 including: a front side view (FIG. 6A) and a top perspective view from the front (FIG. 6B) when safe 200 is used in an inverted (upside down) position allowing door 232 to open from the left.

FIGS. 7A-7I are views of another embodiment of a safe of the invention including: a front side view (7A), a right side view (7B), a right perspective view (7C), a rear side view (7D), a left side view (7E), a top side view (7F), a front perspective view from the top (7G), a bottom side view (7H), and a front perspective view from the bottom (7I) of safe 300.

FIGS. 8A-8B are views of safe 300 including: a front side view (FIG. 8A) and a top perspective view from the front (FIG. 8B) when safe 300 is used in an inverted (upside down) position allowing door 332 to open from the left.

DETAILED DESCRIPTION OF THE INVENTION

The invention provides a modified box-shape safe having an oblique side. The safe includes a modified box-shape cabinet having an open front contiguous with an open oblique side obtusely angled relative to the open front. The safe also includes a door having a rectangular front section adjoining a rectangular oblique side section at an obtuse angle. The front and oblique side sections are configured to occupy the open front and contiguous open oblique side of the cabinet to form a closed chamber when the door is pivoted to a closed position. A hinge pivotably connects the door to the cabinet and allows the door to open from the oblique side of the safe. As such, the user can access the inside of the safe cabinet by reaching in through the open oblique side when the door is pivoted partly open.

A modified box-shape safe of the invention includes a cabinet formed by two vertically oriented, rectangular sections forming the cabinet's back and side wall and two congruent trapezoidal sections forming the cabinet's top and bottom walls. Thus the cabinet of a safe of the invention includes a rectangular back wall, a rectangular side wall, and congruent top and bottom trapezoidal walls. The rectangular back wall, and rectangular side wall each includes two parallel vertical edges and two parallel horizontal edges, the vertical and horizontal edges forming right angle corners.

The rectangular back wall, side wall, or both can resemble a square in which the four edges have the same lengths or resemble a rectangle in which the horizontal edges have a shorter or longer length than that of the vertical edges.

Figure 16A:
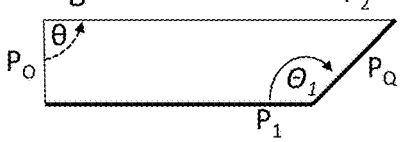
FIGS. 16A-16D are schematic diagrams illustrating the cross-sectional footprints of various embodiments of a safe of the invention.
Figure 16B:
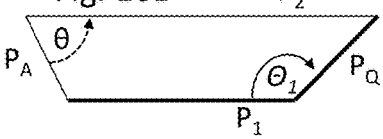
Figure 16C:
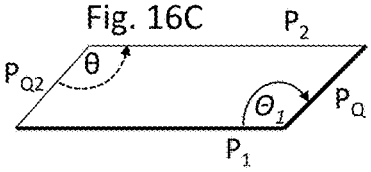
Figure 16D:
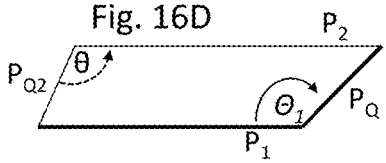

The vertical edges of the back wall and side wall can adjoin any angle θ, for example, at about 90 degrees to form a safe cabinet with a right angle corner (FIG. 16A), at less than 90 degrees to form an acute angle corner (FIG. 16B), or at greater than 90 degrees to form an obtuse angle corner (FIG. 16C-16D). Where the vertical edges of the back wall and side wall adjoin at about 90 degrees to form a right angle corner, the safe has a right trapezoidal top and bottom wall, its cross-section having the shape of a right trapezoid (FIGS. 1G-1H & 16A). Where the vertical edges of the back wall and side wall adjoin at an angle less than about 90 degrees, an acute corner is formed and the safe has a trapezoidal top and bottom wall with a cross-sectional footprint as shown in FIG. 16B. Where the vertical edges of the back wall and side wall adjoin at an angle greater than about 90 degrees, an obtuse corner is formed and the safe has a trapezoidal top and bottom wall with a cross-sectional footprint as shown in FIG. 16C-16D.

The congruent top and bottom trapezoidal walls of a safe of the invention each include two parallel edges, a first and a second parallel edge ($P_1$ and $P_2$), at least one oblique side edge ($P_Q$) extending between the parallel edges, and a second side edge, which can extend perpendicularly between the parallel edges, or extend obliquely at an acute and/or obtuse angle with respect to the parallel edges. The second side edge can be 90 degrees or orthogonal relative to the parallel edges thereby forming an orthogonal edge ($P_O$) (FIG. 16A), less than 90 degrees thereby forming an acute edge ($P_A$) (FIG. 16B), or greater than about 90 degrees thereby forming an obtuse edge ($P_{Q2}$) (FIG. 16C-16D) relative to the parallel edges. The parallel sides can have the same length, or different lengths, for example, a longer and a shorter parallel side. A parallel edge and an adjacent obtusely angled oblique edge of the trapezoidal top and bottom wall of the safe, represented by the bold lines $P_1$ and $P_Q$ in FIGS. 16A-16D, represent the open front and open oblique side of a safe of the invention (or the front section and oblique side section of the safe door as discussed below).

A modified box-shape safe of the invention includes a door formed by two vertically oriented, rectangular sections, a front section adjoining an oblique side section obtusely angled relative to the front section. The front and oblique side door sections are configured to cover the open front and contiguous open oblique side of the safe cabinet. In some embodiments, the safe door includes trapezoidal top and bottom sections that overlay or extends under the trapezoidal cabinet top and bottom walls, respectively. Each of the trapezoidal top and bottom sections of the safe door can include an opening that vertically aligns with an opening on the trapezoidal top and bottom wall of the cabinet when the door is closed. As such, the door can be secured to the cabinet by passing a first lock rod through the aligned openings of the trapezoidal top wall of the cabinet and trapezoidal top section of the safe door on one end and passing a second lock rod through the aligned openings of the trapezoidal bottom wall of the safe cabinet and trapezoidal bottom section of the safe door on the other end of the safe.

In some embodiments, the safe cabinet includes a cabinet face frame surrounding the open front and contiguous open oblique side of the cabinet. The cabinet face frame can include a top horizontal member and a bottom horizontal member, each having a front portion and an oblique side portion perpendicularly adjoining the parallel edge and adjacent oblique side edge of the trapezoidal wall that define the open front and open oblique side of the safe cabinet. The cabinet face frame can include two vertical members, one adjoining a vertical edge of the back wall and the second adjoining the vertical edge of the side wall.

In some embodiments, the safe cabinet and door includes lock flanges each with openings that are in vertical alignment one with the other to accommodate a lock rod for securing the door to the cabinet. Cabinet lock flanges can be horizontally oriented inner flanges perpendicularly adjoining at least a portion of the horizontal frame members extending along the oblique side of the cabinet. Door lock flanges can be horizontally oriented inner flanges perpendicularly adjoining the at least a portion of the top and bottom horizontal edges of the oblique side of the door. Cabinet and door lock flanges each includes a lock opening at the oblique side that vertically align when the door is closed. As such, the door can be secured to the cabinet by passing a first lock rod upward through the aligned openings of door lock flange and cabinet lock flange at the top end and passing a second lock rod down through the aligned openings of the door lock flange and cabinet lock flange on the lower end of the safe.

Any lock system known to those of skilled in the art including electronic lock, combination lock, time lock, or key-operated lock systems can be used in a safe of the invention to secure the obtuse-angled door to the cabinet of the safe. Examples of lock types that can be used in a safe of the invention include single-point, two-point, three-point or multi-point locking systems. Single-point locking system that can be used in a safe of the invention can be disposed mid-point between the top and the bottom of the safe, for example, at a position indicated by the position of lock 133, 233, 333 or 433 on safe 100, 200, 300 or 400, respectively. In these embodiments, a latch or bolt secures the door to the safe cabinet near position of lock 133, 233, 333 or 433 where the key is inserted and turned to lock position. A three-point locking system that can be used in a safe of the invention include one or two lock rods, one end extending vertically upward through openings at or near the top of the safe cabinet and door, while the other end extending vertically downward through openings at or near the bottom of the safe cabinet and door as discussed below. The openings can be disposed on cabinet flanges, door flanges, trapezoidal cabinet walls or trapezoidal door sections, and/or lock caps as described herein. In these embodiments, when the lock is turned or engaged, the rod(s) extend upwards and downwards though the openings and optionally into lock caps as discussed herein to further secure the door to the safe cabinet at the top and bottom of the safe.

Any single-point, two-point, three-point, or multi-point lock systems known to those of skill in the art can be used in a safe of the invention. For examples of single-point, two-point, three-point, or multi-point lock systems known to those of skilled in the art, see the products of OEM Hardware Group (OEM Hardware Group, Glenview, Ill.); sargetnandgreenleaf.com (Sargent and Greenleaf, Nicholasville, Ky.); gssdoors.com (Guardian Security Structures, Comumbia Falls, Mont.); Emtek Products, Inc. (City of Industry, Calif.); and Trilennium Multi-Point Locking Systems (Colfax, N.C.).

A safe of the invention can be configured to have any useful dimensions or shape. For example, a safe of the invention can be dimensioned for use as a free standing safe, for mounting on a wall, for mounting into a wall such as between wall studs.

A safe of the invention is configured to be invertible. Generally, a safe of the invention has horizontal symmetry, which allows the safe to be inverted, i.e. turned upside down, to enable the door to open from the left or the right side of the safe. As used herein, the term "invertible" means functional when rotated end-to-end so that the top of the safe in one orientation becomes the bottom of the safe in the inverted orientation, and the bottom of the safe in one orientation becomes the top of the safe in the inverted orientation. A safe of the invention is invertible when it is functional in two orientations: a first orientation and a second orientation, the second orientation corresponding to a 180-degree rotation of the first orientation such that the top wall of the safe in the first orientation becomes the bottom wall of the safe in the second orientation, the bottom wall of the safe in the first orientation becomes the top wall of the safe in the second orientation, the right side of the safe in the first orientation becomes the left side of the safe in the second orientation, and the left side of the safe in the first orientation becomes the right side of the safe in the second orientation. A safe of the invention having a door that opens from its right side can be inverted and used as a safe having a door that opens from the left side. Thus, a safe of the invention can be used in two orientations, a first orientation in which the safe can be open from the right and a second orientation in which the safe can be open from the left.

Specific embodiments of the invention are described in the following examples, which do not limit the scope of the invention described in the claims.

EXAMPLE

Example 1

Safe 100 with Face Frame

An example of a modified box-shaped safe of the invention is illustrated in FIGS. 1A-1G and FIGS. 2A-2B.

Figure 1A:
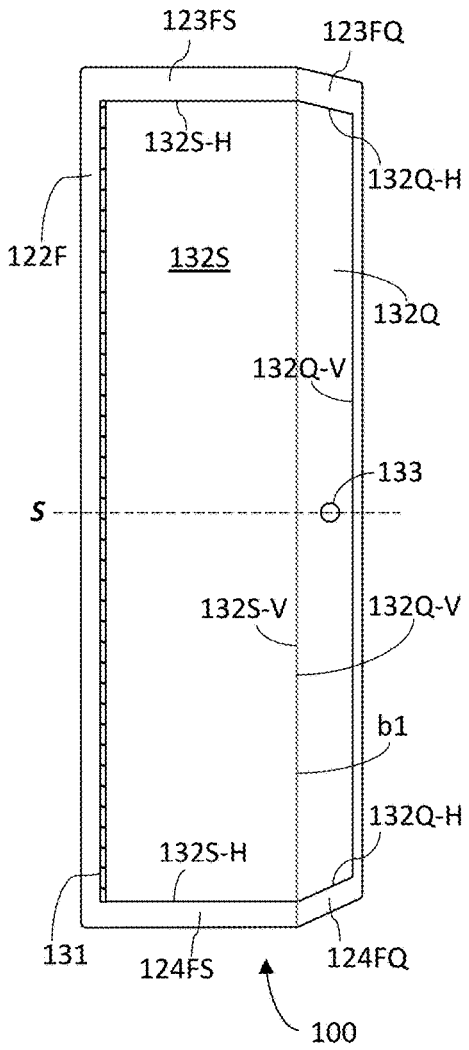
Figure 1B:
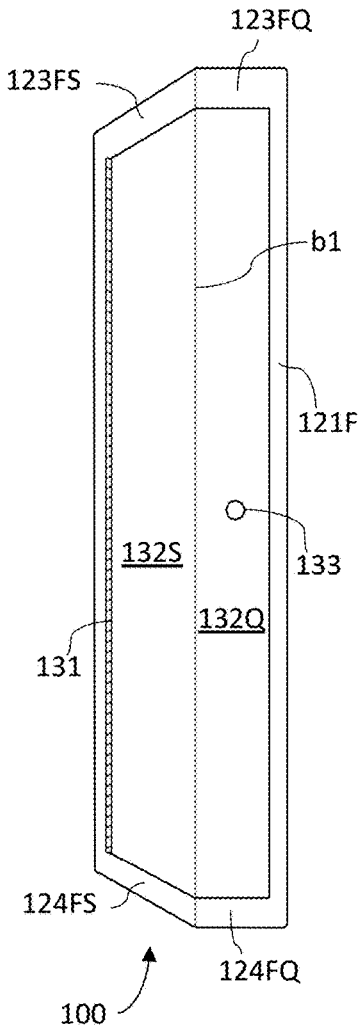
Figure 1C:
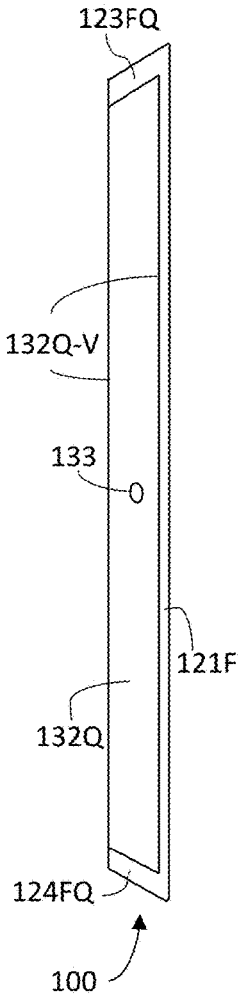

Safe 100 is taller than it is wide. Safe 100 includes door 132 formed by front door section 132S and oblique door side section 132Q. Door section 132S and 132Q are vertically oriented, rectangular sections, each having two parallel vertical edges perpendicular to two parallel horizontal edges. Front door section 132S includes two parallel vertical edges 132S-V perpendicular to two parallel horizontal edge 132S-H. Similarly, adjacent oblique door side section 132Q includes two parallel vertical edges 132Q-V and two parallel horizontal edges 132Q-H. A vertical edge 132S-V of door sections 132S obtusely adjoins a vertical edge 132Q-V of door section 132Q forming bend b1 where front section 132S and adjacent, oblique side 132Q of door 132 meet (FIG. 1A-1C). Front door section 132S is wider than the adjacent oblique door side section 132Q though in other embodiments, the front section of the door can have the same or a narrower width than the width of the adjacent oblique side section. Door 132 is pivotably connected to the cabinet of safe 100 by continuous hinge 131, which is disposed along the vertical edge of the front door section 132S that is distal to the oblique door side section 132Q. As such, door 132 is opened from the oblique side of safe 100, allowing the user access to the interior of safe 100 through the oblique side and enabling access even where door 132 is pivoted to a partly opened position.

Door 132 includes lock 133 disposed about midpoint from the top and bottom end of safe 100 to secure door 132 to the safe cabinet for limiting or preventing access to the interior of safe 100 as further discussed below.

The structure of the cabinet of safe 100 includes: (1) horizontally oriented trapezoidal section 123 forming the top or bottom end of the cabinet (FIG. 1F-1G); (2) horizontally oriented trapezoidal section 124 forming the other end (i.e. top or bottom) of the cabinet (FIG. 1H); (3) narrow, vertically oriented rectangular section 122 forming a first lateral side or side wall of the cabinet (FIG. 1E); (4) wide, vertically oriented rectangular section 121 forming a second lateral side or back wall of the cabinet (FIG. 1D); and (5) front face frame sections 123S, 123Q, 121F, 122F, 124S and 124Q, forming a frame disposed around door 132 (FIG. 1A-1C).

In safe 100, rectangular sections 121 and 122 (FIGS. 1D & 1E) form the back and side wall of safe 100, respectively, and trapezoidal sections 123 and 124 (FIGS. 1G & 1H) each form the top and bottom of safe 100.

Each of rectangular sections 121 and 122 includes two parallel vertical edges perpendicular to two parallel horizontal edges. Rectangular section 121 includes two parallel vertical edges 121-V perpendicular to two parallel horizontal edges 121-H. Similarly, rectangular section 122 includes two parallel vertical edges 122-V and two parallel horizontal edges 122-H. A vertical edge of one of rectangular sections 121 and 122 perpendicularly adjoins a vertical edge of the other of rectangular sections 121 and 122 to form back wall 121 and adjacent, orthogonal side wall 122 of the cabinet. Back wall 121 and adjacent orthogonal side wall 122 adjoin to form right angle corner R1 (FIGS. 1G & 1H) of safe 100.

Trapezoidal sections 123 and 124 each include two parallel edges, a longer and a shorter parallel edge, as well as an orthogonal edge perpendicularly extending between the parallel edges, and an oblique edge extending between the parallel edges forming angles $\theta_1$ and $\theta_2$ (FIGS. 1G & 1H). Trapezoidal section 123 includes longer parallel edge 123-L, shorter parallel edge 124-S, orthogonal edge 123-P, and oblique edge 123-Q. Similarly, trapezoidal section 124 includes longer parallel edge 124-L, shorter parallel edge 124-S, orthogonal edge 124-P, and oblique edge 124-Q.

The longer parallel edge of each trapezoidal section and its adjacent orthogonal edge perpendicularly adjoin a horizontal edge of back wall section 121 and the adjacent horizontal edge of orthogonal side wall 122, respectively, to form the top or bottom of the safe cabinet.

The shorter parallel edge of each trapezoidal section and its adjacent, oblique edge define the front and oblique side of the safe cabinet. Oblique edge 123-Q is acutely angled at about 45 degrees relative to longer paralled edge 123-L and obtusely angled about 135 degrees relative to shorter edge 123-S. Oblique edge 124-Q is acutely angled at about 45 degrees relative to longer paralled edge 124-L and obtusely angled about 135 degrees relative to shorter edge 124-S. As such, the oblique side of the safe 100 is acutely angled at about 45 degrees relative to back wall 121 and obtusely angled about 135 degrees relative to front edge of the cabinet.

Adjacent sides and/or sections of safe 100 adjoin at right angles and are perpendicular with the exception of: (1) adjacent horizontal frame members 123FS and 123FQ, adjacent door sections 132S and 132Q, and adjacent horizontal frame members 124FS and 124FQ, each pair forming obtuse angle $\theta_1$ at bend b1 as described above; and (2) vertical frame member 122F, which adjoin back wall 121 of cabinet at acute angle $\theta_2$ as described above. See FIGS. 1G and 1H.

In other embodiments of a modified, box-shaped safe of the invention, angle $\theta_2$ is an acute angle and can be between 1 degrees and 89 degrees, for example, between about 25 degrees to about 65 degrees, and angle $\theta_1$ is an obtuse angle and can be between 91 degrees and 179 degrees, for example, between about 115 degrees to about 175 degrees. As an obtuse angle is greater than about 90 degrees and less than about 180 degrees, $\theta_1$, in other embodiments of the invention, can be, for example and without limitation, about 95 degrees, about 100 degrees, about 105, degrees, about 110 degrees, about 115 degrees, about 120 degrees, about 125, degrees, about 130 degrees, about 135 degrees, about 140 degrees, about 145, degrees, about 150 degrees, about 155 degrees, about 160 degrees, about 165, degrees, about 170 degrees, or about 175 degrees. An acute angle is less than about 90 degrees and greater than 0 degrees, and thus, $\theta_2$, in other embodiments of the invention, can be, for example and without limitation, about 85 degrees, about 80 degrees, about 75, degrees, about 70 degrees, about 65 degrees, about 60 degrees, about 55, degrees, about 50 degrees, about 45 degrees, about 40 degrees, about 35, degrees, about 30 degrees, about 25 degrees, about 20 degrees, about 15, degrees, about 10 degrees, or about 5 degrees.

The cabinet of safe 100 includes a face frame form by: (1) adjacent horizontal frame members 123FS and 123FQ perpendicularly adjoining shorter parallel edge 123-S and oblique edge 123-Q of trapezoidal section 123 at one end of safe 100; (2) adjacent horizontal frame member 124FS and 124FQ perpendicularly adjoining shorter parallel edge 124-S and oblique edge 124-Q of trapezoidal section 124 at the other end of safe 100; (3) vertical frame member 122F perpendicularly adjoining a vertical edge of orthogonal side wall 122; and (4) vertical frame member 121F adjoining a vertical edge of back wall 121 at acute angle $\theta_2$ as discussed above (FIGS. 1A, 1B & 1C). The cabinet and door of safe 100 include internal lock flanges for securing door to safe cabinet as discussed below for safe 300 and illustrated in FIG. 12

Figure 2A:
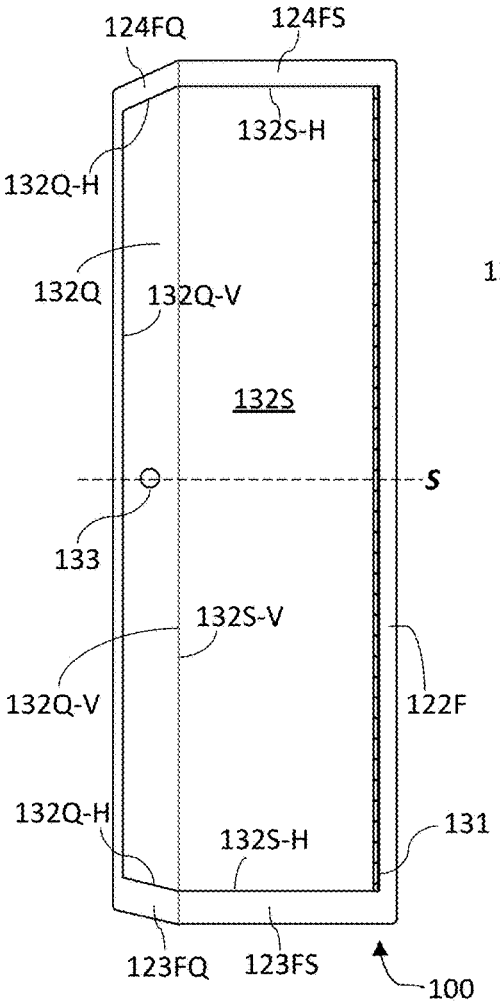
FIGS. 2A-2B are views of safe 100 including: a front side view (FIG. 2A) and a top perspective view from the front (FIG. 2B) when safe 100 is used in an inverted (upside down) position allowing door 132 to open from the left.
Figure 2B:
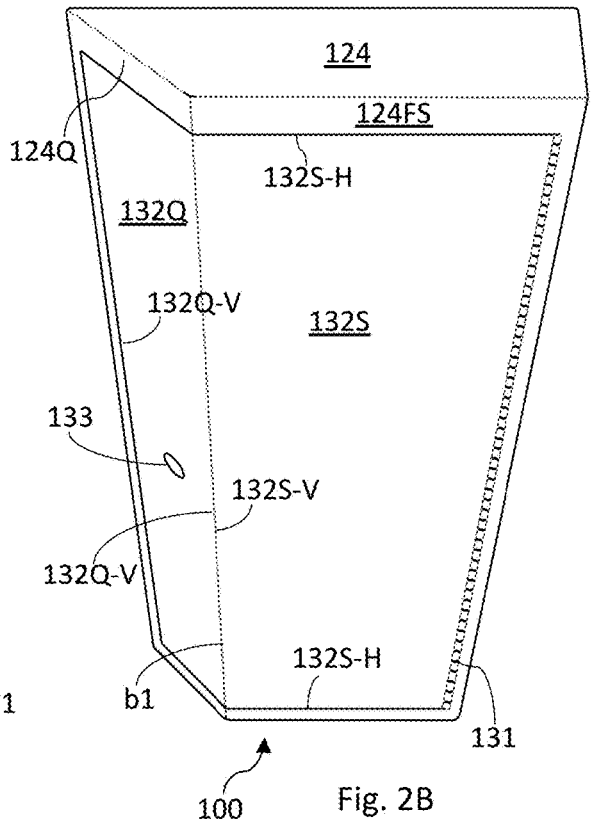

Safe 100 has symmetry about a horizontal plane passing through safe 100 as represented by section line S in FIGS. 1A & 2A. As such, safe 100 is invertible and can be utilize in two orientations as illustrated in FIGS. 1A & 2A. FIGS. 1A & 1F illustrate orientation R in which the oblique side of safe 100 is on its right allowing the user to open safe 100 and access its interior from the right side of safe 100. In orientation R, trapezoidal section 123 forms the top of cabinet 100 (FIG. 1F), and trapezoidal section 124 forms the bottom of cabinet 100. Safe 100 can be inverted to allow the user to open and access the safe's interior from the other side where convenient. FIGS. 2A & 2B illustrate orientation L in which the oblique side of safe 100 is on its left allowing the user to open safe 100 and access its interior from the left of safe 100. In orientation L, trapezoidal section 124 forms the top of cabinet 100 (FIG. 2B), and trapezoidal section 123 forms the bottom of cabinet 100.

Example 2

Safe 200

A second example of a modified box-shaped safe of the invention is illustrated in FIGS. 3A-3H, 4A-4H and 6A-6B. Safe 200 includes door 232 formed by front door section 232S, adjacent oblique door side section 232Q, and two trapezoidal sections 232R and 232L, which form the top and bottom of door 232 (FIGS. 3A-3C, 3F-3H, & 6A-6B).

Figure 3A:
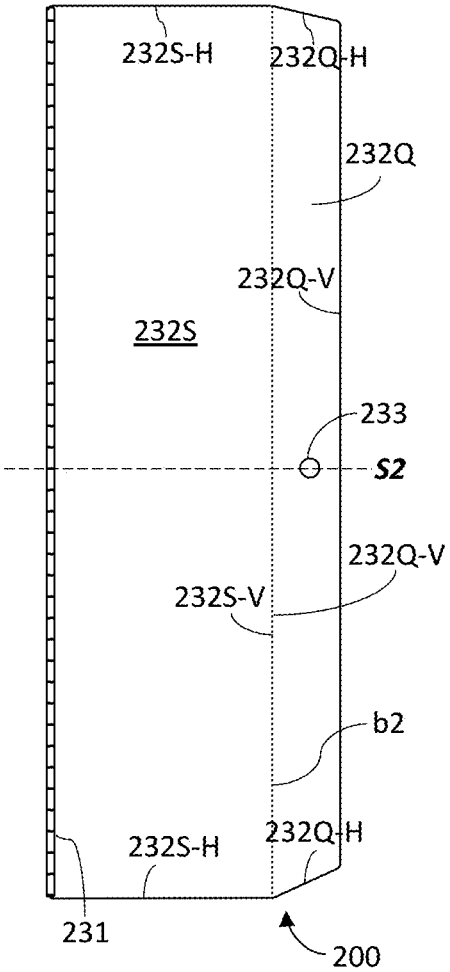
Figure 3B:
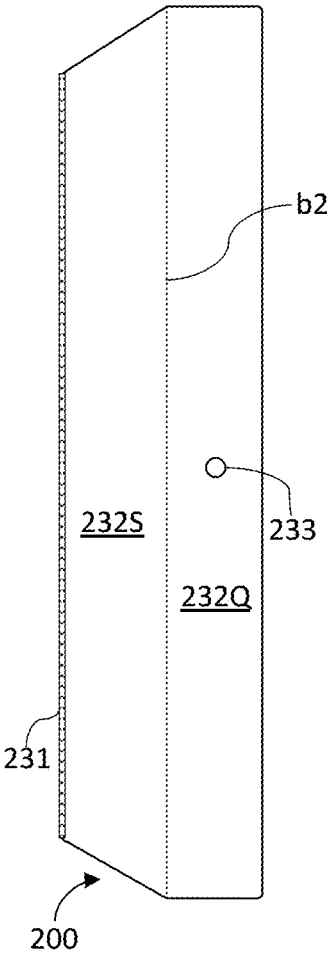
Figure 3C:
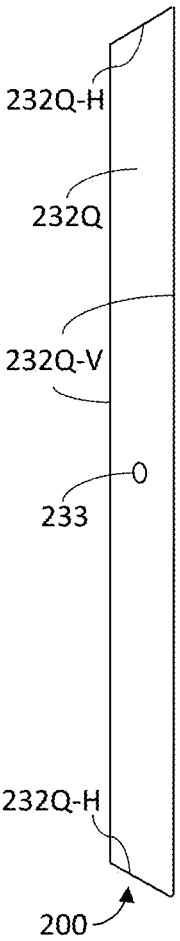

Front and oblique door sections 232S and 232Q are vertically oriented, rectangular sections, each having two parallel vertical edges perpendicular to two parallel horizontal edges. Front door section 232S includes two parallel vertical edges 232S-V perpendicular to two parallel horizontal edge 232S-H. Similarly, adjacent oblique door side section 232Q includes two parallel vertical edges 232Q-V and two parallel horizontal edges 232Q-H. A vertical edge 232S-V door sections 232S obtusely adjoins a vertical edge 232Q-V of door section 232Q forming bend b2 where front section 232S and adjacent, oblique side section 232Q of door 232 meet (FIG. 3A-3C). Front door section 232S is wider than the adjacent oblique door side section 232Q though in other embodiments, the front section of the door can have the same or a narrower width than the width of the adjacent oblique side section.

The top and bottom of door 232 are formed by horizontally oriented, trapezoidal sections 232R and 232L, which extend over the top and under the bottom of the cabinet safe, trapezoidal door section 232R overlaying trapezoidal cabinet section 223 (FIG. 4F, 4G), and trapezoidal door section 232L extending beneath trapezoidal cabinet section 224 (FIG. 4F, 4H).

Trapezoidal door sections 232R and 232L each includes two parallel edges, a longer and a shorter parallel edge, as well as an orthogonal edge perpendicularly extending between the parallel edges, and an oblique edge extending between the parallel edges forming angles $\theta_1$ and $\theta_2$ (FIG. 3G-3H). Trapezoidal door section 232R includes longer parallel edge 232R-L, shorter parallel edge 232R-S, orthogonal edge 232R-P, and oblique edge 232R-Q. Oblique edge 232R-Q is acutely angled at about 45 degrees relative to longer parallel edge 232R-L and obtusely angled about 135 degrees relative to shorter edge 232R-S. Trapezoidal door section 232L includes longer parallel edge 232L-L, shorter parallel edge 232L-S, orthogonal edge 232L-P, and oblique edge 232L-Q. Oblique edge 232L-Q is acutely angled at about 45 degrees relative to longer parallel edge 232L-L and obtusely angled about 135 degrees relative to shorter edge 232L-S. As such, oblique door section 232Q is acutely angled at about 45 degrees relative to back of safe 200 and obtusely angled about 135 degrees relative to front door section 232S.

The shorter parallel edge of each trapezoidal door section and its adjacent oblique edge perpendicularly adjoin a horizontal edge of front door section 232S and the adjacent horizontal edge of adjacent oblique door section 232Q, respectively, to form the top or bottom of the door 232. Specifically, shorter parallel edge 232R-S and adjacent oblique edge 232R-Q of trapezoidal door section 232R perpendicularly adjoin horizontal edge 232S-H of front door section 232S and adjacent horizontal edge 232Q-H of adjacent oblique door section 232Q, respectively, to form one end of door 232 as shown in FIG. 3F. Similarly, shorter parallel edge 232L-S and adjacent oblique edge 232L-Q of trapezoidal door section 232L perpendicularly adjoin horizontal edge 232S-H of front door section 232S and adjacent horizontal edge 232Q-H of adjacent oblique door section 232Q, respectively, to form the other end of door 232 as shown in FIG. 6B.

The longer parallel edge of each trapezoidal door section and its adjacent, orthogonal edge form the free back and orthogonal edges of the trapezoidal end sections of door 232 as illustrated in FIGS. 4A-4D. Specifically, longer parallel edge 232R-L of trapezoidal door section 232R form the free back edge of trapezoidal end section 232R of door 232 as shown in FIGS. 4A-4B, which illustrate the upper left and right corners of safe 200, respectively, as viewed from the rear. Adjacent, orthogonal edge 232R-P of trapezoidal door section 232R form the free orthogonal edge of trapezoidal end section 232R and door 232 as illustrated in FIGS. 4B &

4G. Similarly, longer parallel edge 232L-L of trapezoidal door section 232L form the free back edge of trapezoidal end section 232L of door 232 as shown in FIGS. 4C-4D, which illustrate the lower left and right corners of safe 200, respectively, as viewed from the rear. Adjacent, orthogonal edge 232L-P form the free orthogonal edge of trapezoidal end section 232L and door 232 (FIGS. 4D & 4H). Trapezoidal door sections 232R and 232L extend over the top (FIGS. 4A-4B & 4F-4G) and under the bottom (FIGS. 4C-4D & 4F, 4H) of the safe cabinet, overlaying the top and extending below the bottom of safe cabinet as illustrated in FIGS. 4A-4H. Clearance space 240 between the door sections and the safe cabinet allow the door 232 to smoothly close over the top and under the bottom of the cabinet of safe 200.

Door 232 includes lock 233 disposed about midpoint from the top and bottom end of safe 200 to secure door 232 to the safe cabinet for limiting or preventing access to the interior of safe 200.

Door 232 also includes lock cap 235 disposed on trapezoidal door section 232R and 232L as illustrated in FIGS. 3F and 6B. Lock cap 235 is a cylindrical structure (FIG. 5A-5D) with a hollow interior disposed on the surface of trapezoidal door section 232R and 232L. The lateral side of lock cap 235 extends perpendicular from the edge of openings on trapezoidal door section 232R and 232L, the hollow interior of each lock cap 235 aligning with the openings on trapezoidal door section 232R and 232L so as to receive a lock rod extending through the openings into lock cap 235. Lock cap 235 includes three cutouts 235C on its lateral side through which the lock status of the safe can be viewed based the presence of a lock rod in lock cap 235 (FIG. 5A-5D). In locked position, an end of a lock rod is passed through openings on trapezoidal cabinet section 223 and door section 232R into lock cap 435 (FIG. 5A), and the other end of the lock rod is passed through openings on trapezoidal cabinet section 224 and door section 232L into lock cap 435 (FIG. 5C), to secure door 232 to the cabinet of safe 200. The ends of the lock rod, e.g. rod 233R, are visible through cutouts 235C (FIG. 5A, 5C). In unlocked position, no rod is visible through cutouts 235C (FIG. 5B, 5D).

Door 232 is pivotably connected to the cabinet of safe 200 by continuous hinge 231, which is disposed along the vertical edge of the front door section 232S that is distal to the oblique door section 232Q. As such, door 232 is opened from the oblique side of safe 200, allowing the user access to the interior of safe 200 through the oblique side and enabling access even where door 232 is pivoted to a partly opened position.

The structure of the cabinet of safe 200 includes: (1) horizontally oriented trapezoidal section 223 forming the top or bottom end of the cabinet (not shown); (2) horizontally oriented trapezoidal section 224 (not shown) forming the other end (i.e. top or bottom) of the cabinet; (3) vertically oriented rectangular section 222 forming a first lateral side or side wall of the cabinet; and (4) vertically oriented rectangular section 221 forming a second lateral side or back wall of the cabinet.

Trapezoidal cabinet sections 223 and 224 (not shown) have structures analogous to trapezoidal door sections 232R and 232L, respectively (FIGS. 3G & 3H). Trapezoidal cabinet sections 223 and 224 each includes two parallel edges, a longer and a short parallel edge, as well as an orthogonal edge perpendicularly extending between the parallel edges, and an oblique edge extending between the parallel edges forming angles analogous to angle $\theta_1$ and $\theta_2$ shown in FIGS. 3G and 3H. Trapezoidal cabinet section 223 includes longer parallel edge 223-L, shorter parallel edge 223-S, orthogonal edge 223-P, and oblique edge 223-Q. Similarly, trapezoidal section 224 includes longer parallel edge 224-L, shorter parallel edge 224-S, orthogonal edge 224-P, and oblique edge 224-Q.

The shorter parallel edge of each trapezoidal cabinet section and its adjacent, oblique edge define the open front and contiguous open oblique side of the safe cabinet, respectively. Oblique cabinet edge 223-Q is obtusely angled about 135 degrees relative to shorter parallel cabinet edge 223-S and acutely angled at about 45 degrees relative to longer parallel cabinet edge 223-L. Oblique cabinet edge 224-Q is obtusely angled about 135 degrees relative to shorter parallel cabinet edge 224-S and acutely angled at about 45 degrees relative to longer parallel cabinet edge 224-L. As such, the oblique side of the safe 200 is obtusely angled about 135 degrees relative to front of the cabinet and acutely angled at about 45 degrees relative to back wall of safe 200. The longer parallel edge of each trapezoidal cabinet section and its adjacent orthogonal edge perpendicularly adjoin a horizontal edge of rectangular back wall section 221 and the adjacent horizontal edge of rectangular side wall 222, respectively, as discussed below to form the top or bottom of the safe cabinet.

Each of rectangular sections 221 and 222 includes two parallel vertical edges perpendicular to two parallel horizontal edges. Rectangular section 221 includes parallel vertical edges 221-V that are perpendicular to two parallel horizontal edges 221-H. Similarly, rectangular section 222 includes parallel vertical edges 222-V and parallel horizontal edges 222-H. A vertical edge of one of rectangular sections 221 and 222 perpendicularly adjoins a vertical edge of the other of rectangular sections 221 and 222 to form back wall 221 and adjacent, orthogonal side wall 222 of the cabinet. Back wall 221 and adjacent orthogonal side wall 222 adjoin perpendicularly to form a right angle corner extending between or co-extensive with right angle R2 (FIG. 3G, 3H) formed by adjacent perpendicular edges of trapezoidal door section 232R and 232L, in particular, long parallel edge 232R-L and adjacent orthogonal edge 232R-P on one end of safe (FIG. 3G) and long parallel edge 232L-L and adjacent orthogonal edge 232L-P on the other end of safe 100 (FIG. 3H).

Back wall 221 has a shorter length than that of adjacent orthogonal side wall 222. As such, back wall 221 adjoins side wall 222 so horizontal edges 221-H of back wall 221 is off set from horizontal edges 222-H of side wall 221 resulting in side overhangs 222O extending above and below trapezoidal cabinet top and bottom as illustrated in FIGS. 4F-4H. Side overhangs 222O allow trapezoidal door sections 232R and 232L to lay flush with the horizontal edge 222-H of side wall 222 as illustrated in FIGS. 4A-4H.

In some embodiments, safe 200 is constructed without a face frame. In these embodiments, the cabinet has an open front and contiguous open oblique side that is defined by the shorter parallel edges and adjacent oblique edges of trapezoidal cabinet sections 223 and 234 at the top and bottom and the vertical edges of the side wall and back wall of safe 200. In these embodiments, door 232 is configured to be wider and longer than the cabinet so as to fully overlay the edges of the safe cabinet. As such, the edges of the safe cabinet, as well as the open front and contiguous open oblique side are covered by or hidden behind door 232 when door 232 is closed as illustrated in FIGS. 3A, 3B and 3F.

In other embodiments, safe 200 is constructed with one or more of face frame members 223S, 223Q, 221F, 222F, 224S and 224Q (not shown), analogous to face frame members 123S, 123Q, 121F, 122F, 124S and 124Q of safe 100, respectively. Where safe 200 is constructed with face frame members, door 232 can be configured to be wider and longer than the face frame members so as to fully overlay the face frame members. As such, the face frame members, as well as the open front and contiguous open oblique side of safe 200 are fully covered by or hidden behind door 232 when it is closed as illustrated in FIGS. 3A-3C and 3F.

Safe 200 also includes lock cap 235 disposed on trapezoidal door sections 232R and 232L near their oblique edges. A lock cap of a safe of the invention is further discussed below.

Safe 200 has symmetry about a horizontal plane passing through safe 200 as represented by section line S2 in FIGS. 3A & 6A. As such, safe 200 is invertible and can be utilize in two orientations as illustrated in FIGS. 3A-3B, 3F, & 6A-6B. FIGS. 3A-3B & 3F illustrate orientation R in which the oblique side of safe 200 is on its right allowing the user to open safe 200 and access its interior from the right side of safe 200. In orientation R, trapezoidal door section 232R (FIG. 3G) overlays trapezoidal cabinet section 223, trapezoidal door section 232R and cabinet section 223 forming the top end of safe 200 as shown in FIGS. 3F and 4F-4G, and trapezoidal door section 232L (FIG. 3H) extends under trapezoidal cabinet section 224, both of which forming the bottom end of cabinet 200 as shown in FIGS. 4F, 4G-4H. FIGS. 6A & 6B illustrate safe 200 in orientation L in which the oblique side of safe 200 is on its left allowing the user to open safe 200 and access its interior from the left side. In orientation L, trapezoidal door section 232L (FIG. 6B) overlays trapezoidal cabinet section 224 (hidden), both of which forming the top end of cabinet 200 (FIG. 6B), and trapezoidal door section 232R (FIG. 3G) extends under trapezoidal cabinet section 223 (hidden), both of which forming the bottom end of cabinet 200.

Example 3

Safe 300

A third example of a modified box-shaped safe of the invention is illustrated in FIGS. 7A-7I, 8A-8B and 12. Safe 300 includes structural components analogous to those described for safe 100 with the exception that safe 300 is wider than it is tall.

Figure 7A:
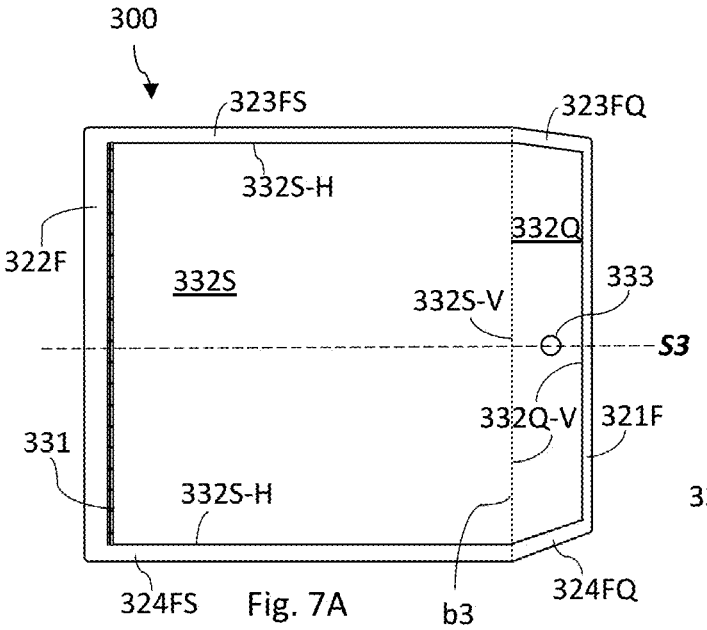
Figure 7B:
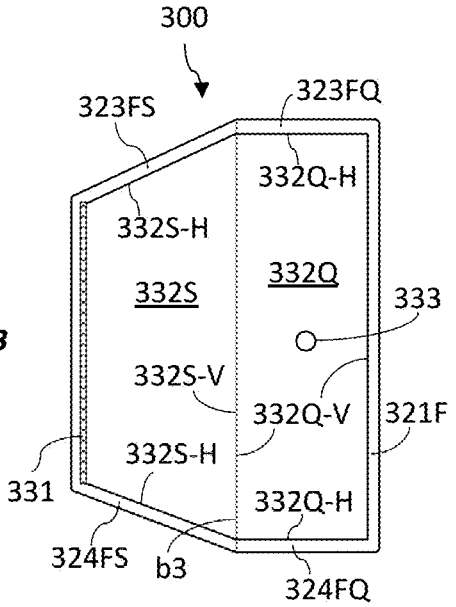
Figure 7C:
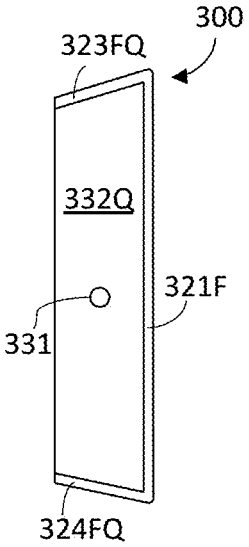
Figure 7D:
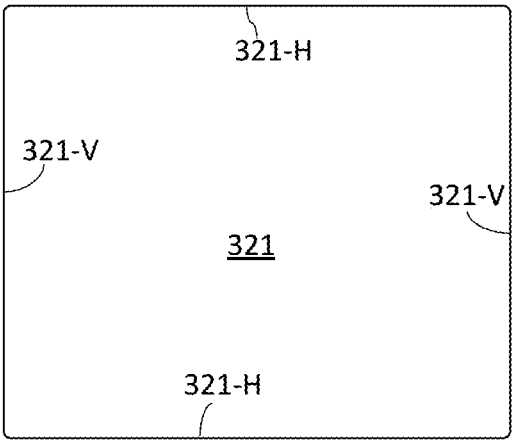

Safe 300 includes door 332 formed by front door section 332S and oblique door side section 332Q. Door section 332S and 332Q are vertically oriented, rectangular sections, each having two parallel vertical edges perpendicular to two parallel horizontal edges. Front door section 332S includes two parallel vertical edges 332S-V perpendicular to two parallel horizontal edge 332S-H. Similarly, adjacent oblique door side section 332Q includes two parallel vertical edges 332Q-V and two parallel horizontal edges 332Q-H. A vertical edge 332S-V of door sections 332S obtusely adjoins a vertical edge 332Q-V of door section 332Q forming bend b3 where front section 332S and adjacent, oblique side 332Q of door 332 meet (FIG. 7A-7C). Front door section 332S is wider than the adjacent oblique door side section 332Q though in other embodiments, the front section of the door can have the same or a narrower width than the width of the adjacent oblique side section. Door 332 is pivotably connected to the cabinet of safe 300 by continuous hinge 331, which is disposed along the vertical edge of the front door section 332S that is distal to the oblique door side section 332Q. As such, door 332 is opened from the oblique side of safe 300, allowing the user access to the interior of safe 300 through the oblique side and enabling access even where door 332 is pivoted to a partly opened position.

Door 332 includes lock 333 disposed about midpoint from the top and bottom end of safe 300 to secure door 332 to the safe cabinet for limiting or preventing access to the interior of safe 300 as further discussed below.

Figure 7E:
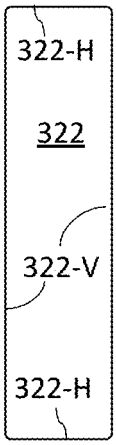

The structure of the cabinet of safe 300 includes: (1) narrow, vertically oriented rectangular section 322 forming a first lateral side or side wall of the cabinet (FIG. 7E); (2) wide, vertically oriented rectangular section 321 forming a second lateral side or back wall of the cabinet (7D); (3) horizontally oriented trapezoidal section 323 forming the top or bottom end of the cabinet (FIGS. 7F-7G; 8B); (4) horizontally oriented trapezoidal section 324 forming the other end (i.e. top or bottom) of the cabinet (FIGS. 7H-7I; 8B); and (5) front face frame sections 323S, 323Q, 323F, 322F, 324S and 324Q, forming a frame disposed around door 332 (7A-7C).

Each of rectangular sections 321 and 322 includes two parallel vertical edges perpendicular to two parallel horizontal edges. Rectangular section 321 includes parallel vertical edges 321-V perpendicular to parallel horizontal edges 321-H. Similarly, rectangular section 322 includes parallel vertical edges 322-V and parallel horizontal edges 322-H. A vertical edge 321-V of rectangular section 321 perpendicularly adjoins a vertical edge 322-V of rectangular section 322 to form back wall 321 and adjacent, orthogonal side wall 322 of the cabinet.

Trapezoidal sections 323 and 324 each include two parallel edges, a longer and a shorter parallel edge, as well as an orthogonal edge perpendicularly extending between the parallel edges, and an oblique edge extending between the parallel edges forming angles $\theta_3$ and $\theta_2$ (FIGS. 7F & 7H). Trapezoidal section 323 includes longer parallel edge 323-L, shorter parallel edge 324-S, orthogonal edge 323-P, and oblique edge 323-Q (FIG. 7G). Similarly, trapezoidal section 324 includes longer parallel edge 324-L, shorter parallel edge 324-S, orthogonal edge 324-P, and oblique edge 324-Q (FIG. 7I).

The longer parallel edge of each trapezoidal section and its adjacent orthogonal edge perpendicularly adjoin a horizontal edge of back wall section 321 and the adjacent horizontal edge of orthogonal side wall 322, respectively, to form the top or bottom of the safe cabinet (FIGS. 7G, 7I).

The shorter parallel edge of each trapezoidal section and its adjacent, oblique edge define the front and oblique side of the safe cabinet. Oblique edge 323-Q is acutely angled at about 45 degrees relative to longer parallel edge 323-L and obtusely angled about 135 degrees relative to shorter edge 323-S. Oblique edge 324-Q is acutely angled at about 45 degrees relative to longer parallel edge 324-L and obtusely angled about 135 degrees relative to shorter edge 324-S. As such, the oblique side of the safe 300 is acutely angled at about 45 degrees relative to back wall 323 and obtusely angled about 135 degrees relative to front edge of the cabinet.

Adjacent sides and/or sections of safe 300 adjoin at right angles and are perpendicular with the exception of: (1) adjacent horizontal frame members 323FS and 323FQ, adjacent door sections 332S and 332Q, and adjacent horizontal frame members 324FS and 324FQ, each pair forming obtuse angle $\theta_1$ at bend b3 as described above; and (2) vertical frame member 322F, which adjoin back wall 321 of cabinet at acute angle $\theta_2$ as described above.

Figure 12:
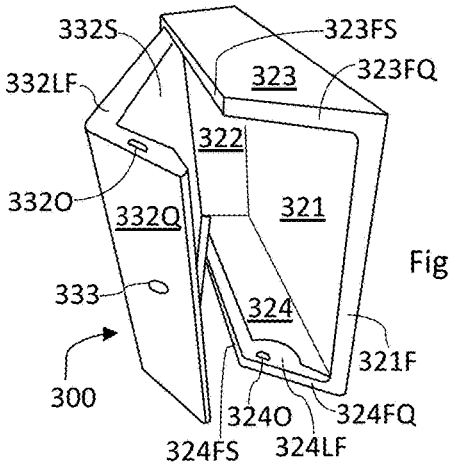
FIG. 12 is a top perspective view of safe 300 from the open side.

The cabinet of safe 300 includes a face frame form by: (1) adjacent horizontal frame members 323FS and 323FQ perpendicularly adjoining shorter parallel edge 323-S and oblique edge 323-Q of trapezoidal section 323 at one end of safe 300 (FIGS. 7A & 12); (2) adjacent horizontal frame member 324FS and 324FQ perpendicularly adjoining shorter parallel edge 324-S and oblique edge 324-Q of trapezoidal section 324 at the other end of safe 300 (FIGS. 7A & 12); (3) vertical frame member 322F perpendicularly adjoining a vertical edge of orthogonal side wall 322 (FIG. 7A); and (4) vertical frame member 321F adjoining a vertical edge of back wall 321 at acute angle $\theta_2$ as discussed above (FIG. 7A-7C, 12).

Safe 300 further includes inner lock flanges on the cabinet and doors that extend into the interior of safe 300. Cabinet lock flange 324LF is horizontally oriented and perpendicularly adjoins the horizontal edges of frame members 324FS and 324FQ at one end (FIG. 12). And similar cabinet lock flange 323LF is horizontally oriented and perpendicularly adjoins the horizontal edges of frame members 323FS and 323FQ beneath trapezoidal cabinet section 323 at the other end (not shown). Door lock flanges 332LF are similarly horizontally oriented and perpendicularly adjoin horizontal door edges 332S-H and 332Q-H at both ends of safe door. Door lock flange 332LF perpendicularly adjoining the horizontal door edges 332S-H and 332Q-H at the top of safe door 332 is illustrated in FIG. 12. A similar door lock flange 332LF adjoins the horizontal door edges 332S-H and 332Q-H at the bottom of safe door 332 (not shown). In a safe of the invention, a door lock flange 332LF is positioned beneath a cabinet lock flange at one end of the safe and a door lock flange 332LF is positioned above cabinet lock flange 324LF at the other end of the safe when door is closed (FIG. 12). Cabinet and door lock flanges can have similar or different shapes so long as the door and cabinet lock flanges all include openings that are aligned to enable a lock rod to pass through the openings as discussed below. More specifically, door lock flange 332LF is configured with opening 332O that aligns with openings 323O at one end and opening 324O at the other end of cabinet lock flanges 323LF and 324LF, respectively when door 332 is pivoted closed. When door 332 is closed, openings 332O, 323O and 324O are vertically aligned so as to enable a first rod to extend through openings 332O and 323O at one end, and a second rod to extend through openings 332O and 324O at the other end, thereby securing door 332 to the cabinet of safe 300. Thus, safe 300 includes matched lock openings on interior sections of the cabinet and door that similarly enable a lock rod of a two or three-point lock system to pass through to secure the door to the cabinet of the safe.

Safe 300 has symmetry about a horizontal plane passing through safe 300 as represented by section line S3 in FIGS. 7A & 8A. As such, safe 300 is invertible and can be utilize in two orientations as illustrated in FIGS. 7A & 8A. FIGS. 7A-7B, 7G & 7I illustrate orientation R in which the oblique side of safe 300 is on its right allowing the user to open safe 300 and access its interior from the right side of safe 300. In orientation R, trapezoidal section 323 forms the top of cabinet 300 (FIG. 7G), and trapezoidal section 324 forms the bottom of cabinet 300 (FIG. 7I). Safe 300 can be inverted to allow the user to open and access the safe's interior from the other side where convenient. FIGS. 8A & 8B illustrate orientation L in which the oblique side of safe 300 is on its left allowing the user to open safe 300 and access its interior from the left of safe 300. In orientation L, trapezoidal section 324 forms the top of cabinet 300 (FIG. 8B), and trapezoidal section 323 forms the bottom of cabinet 300.

Example 4

Safe 400

A fourth example of a modified box-shaped safe of the invention is illustrated in FIGS. 9A-9I, 10A-10B and 11A-11D. Safe 400 includes door 432 formed by front door section 432S, adjacent oblique door side section 432Q, and two trapezoidal sections 432R and 432L, which form the top and bottom of door 432 (FIGS. 9F-9I, 10B & 11A-11C).

Figure 9A:
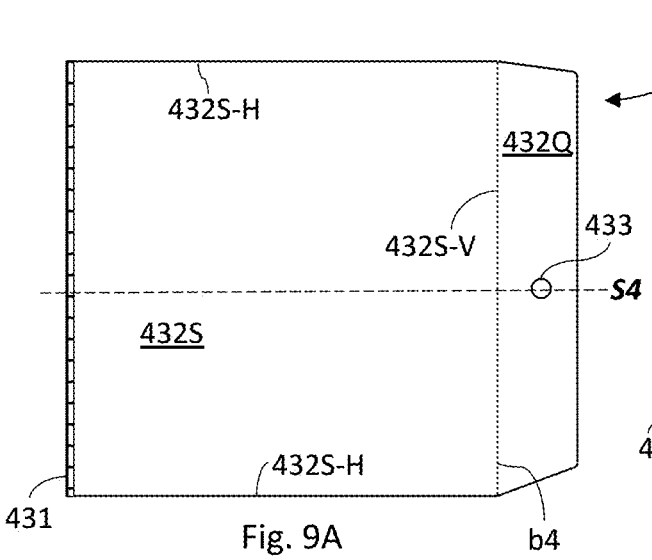
FIGS. 9A-9I are views of a fourth embodiment of a safe of the invention including a front side view (FIG. 9A), a right side view (FIG. 9B), a right perspective view (FIG. 9C), a rear side view (FIG. 9D), a left side view (FIG. 9E), a front perspective view from the top (FIG. 9F), a top plan view (FIG. 9G), a front perspective few from the bottom (FIG. 9H), and a bottom side view (FIG. 9I) of safe 400.
Figure 9B:
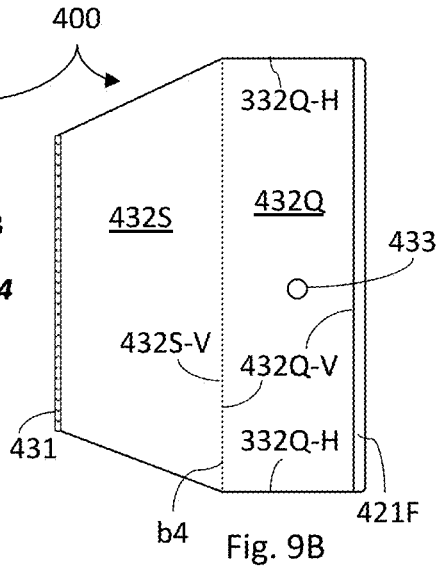
Figure 9C:
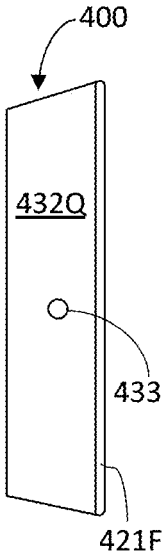

Front and oblique door sections 432S and 432Q are vertically oriented, rectangular sections, each having two parallel vertical edges perpendicular to two parallel horizontal edges. Front door section 432S includes two parallel vertical edges 432S-V perpendicular to two parallel horizontal edge 432S-H. Similarly, adjacent oblique door side section 432Q includes two parallel vertical edges 432Q-V and two parallel horizontal edges 432Q-H. A vertical edge 432S-V of door sections 432S obtusely adjoins a vertical edge 432Q-V of door section 432Q forming bend b4 where front door section 432S and adjacent, oblique side door section 432Q of door 432 meet (FIGS. 9A-9B). Front door section 432S is wider than the adjacent oblique door side section 432Q though in other embodiments, the front section of the door can have the same or a narrower width than the width of the adjacent oblique side section.

The top and bottom of door 432 are formed by horizontally oriented, trapezoidal sections 432R and 432L, which extend over the top and under the bottom of the cabinet safe, trapezoidal door section 432R overlaying trapezoidal cabinet section 423, and trapezoidal door section 432L extending beneath trapezoidal cabinet section 422 as described above for safe 200 and illustrated in FIGS. 9F-9I, 11A-11B & 11D.

Figure 9D:
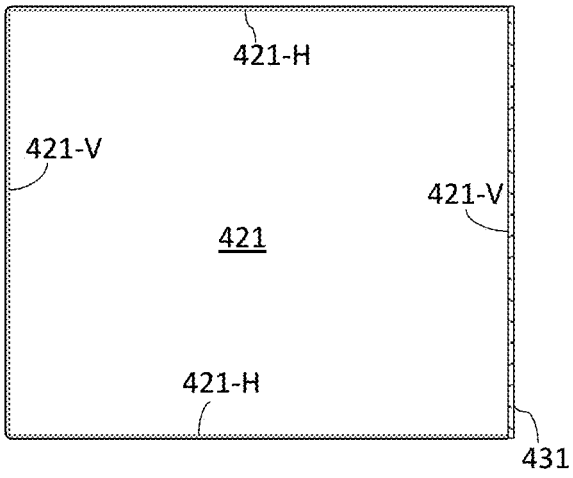
Figure 9E:
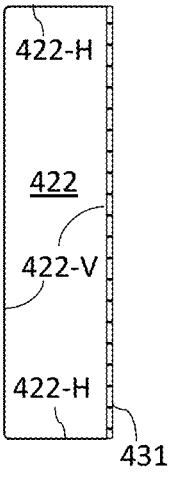
Figure 9F:
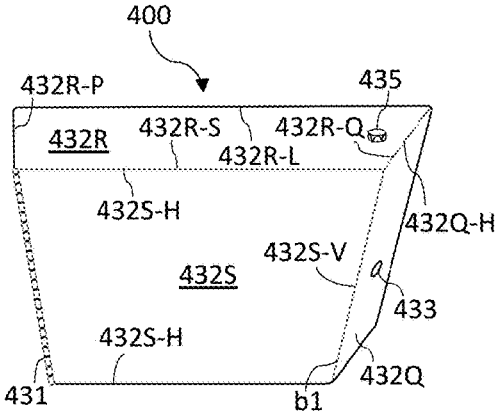
Figure 9H:
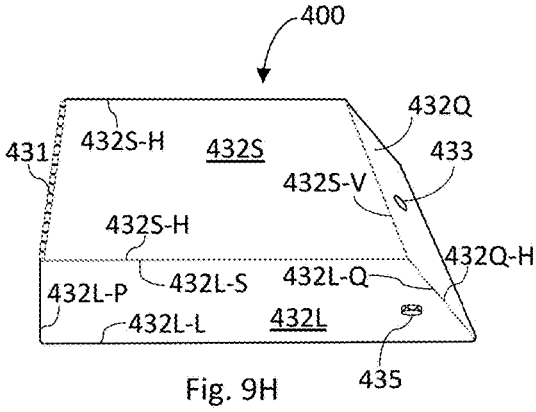
Figure 9G:
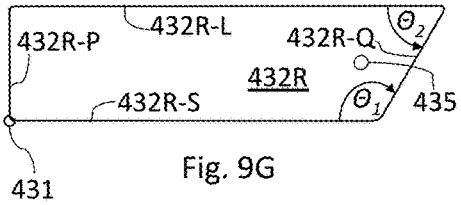
Figure 9I:
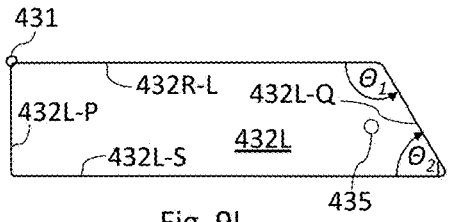

Trapezoidal door sections 432R and 432L each includes two parallel edges, a longer and a shorter parallel edge, as well as an orthogonal edge perpendicularly extending between the parallel edges, and an oblique edge extending between the parallel edges forming angles $\theta_1$ and $\theta_2$ (FIG. 9F-9I). Trapezoidal door section 432R includes longer parallel edge 432R-L, shorter parallel edge 432R-S, orthogonal edge 432R-P, and oblique edge 432R-Q. Oblique edge 432R-Q is acutely angled at about 45 degrees relative to longer parallel edge 432R-L ($\theta_2$) and obtusely angled about 135 degrees relative to shorter edge 432R-S ($\theta_1$) (FIG. 9G). Trapezoidal door section 432L includes longer parallel edge 432L-L, shorter parallel edge 432L-S, orthogonal edge 432L-P, and oblique edge 432L-Q. Oblique edge 432L-Q is acutely angled at about 45 degrees relative to longer parallel edge 432L-L ($\theta_2$) (and obtusely angled about 135 degrees relative to shorter edge 432L-S ($\theta_1$) (FIG. 9I). As such, oblique door section 432Q is acutely angled at about 45 degrees relative to back of safe 400 and obtusely angled about 135 degrees relative to front door section 432S.

The shorter parallel edge of each trapezoidal door section and its adjacent oblique edge perpendicularly adjoin a horizontal edge of front door section 432S and the adjacent horizontal edge of adjacent oblique door section 432Q, respectively, to form the top or bottom of the door 432 (FIGS. 9F & 11A-11C). Specifically, shorter parallel edge 432R-S and adjacent oblique edge 432R-Q of trapezoidal door section 432R perpendicularly adjoin horizontal edge 432S-H of front door section 432S and adjacent horizontal edge 432Q-H of adjacent oblique door section 432Q, respectively, to form one end of door 432 as shown in FIG. 9F. Similarly, shorter parallel edge 432L-S and adjacent oblique edge 432L-Q of trapezoidal door section 432L perpendicularly adjoin horizontal edge 432S-H of front door section 432S and adjacent horizontal edge 432Q-H of adjacent oblique door section 432Q, respectively, to form the other end of door 432 as shown in FIG. 9H.

Figure 11A:
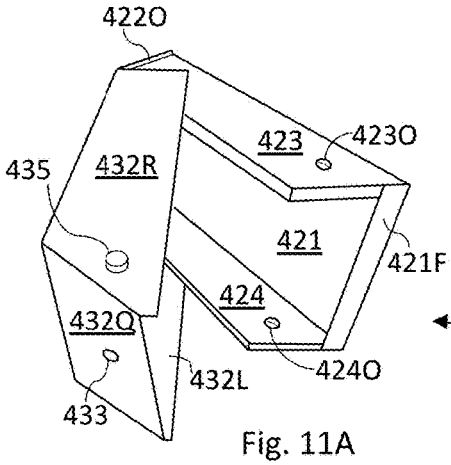
FIGS. 11A-11D are perspective views of safe 400 when opened including a top perspective view from the open side (FIG. 11A), a bottom perspective view from the open side (FIG. 11B), a top perspective view from the front (11C) and a side perspective view from the open side (FIG. 11D).
Figure 11B:
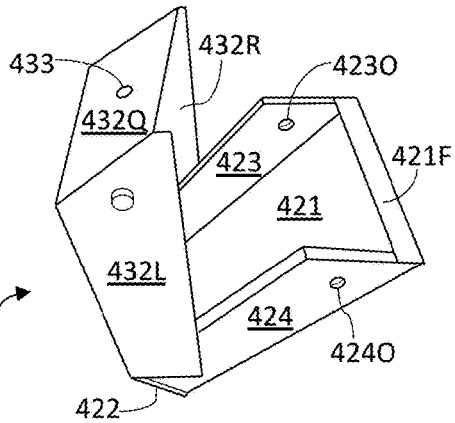
Figure 11C:
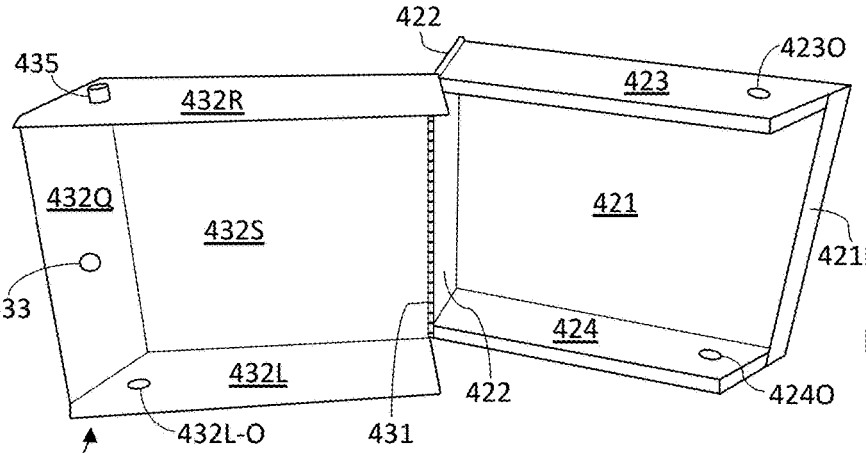
Figure 11D:
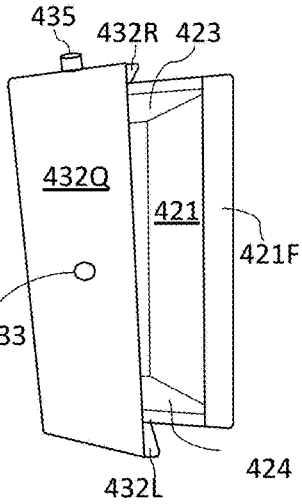

The longer parallel edge of each trapezoidal door section and its adjacent, orthogonal edge form the free back and orthogonal edges of the trapezoidal end sections of door 432 as discussed for safe 200 and as shown in FIGS. 11A-11C. Specifically, longer parallel edge 432R-L of trapezoidal door section 432R form the free back edge of trapezoidal end section 432R of door 432. Adjacent, orthogonal edge 432R-P of trapezoidal door section 432R form the free orthogonal edge of trapezoidal end section 432R and door 432. Similarly, longer parallel edge 432L-L of trapezoidal door section 432L form the free back edge of trapezoidal end section 432L of door 432. Adjacent, orthogonal edge 432L-P form the free orthogonal edge of trapezoidal end section 432L and door 432. Trapezoidal door sections 432R and 432L extend over the top and under the bottom of the safe cabinet, overlaying top and extending below the bottom of safe cabinet as discussed for safe 200 and illustrated in FIGS. 11A-11B & 11D. Clearance space between the door sections and the safe cabinet allow the door 432 to smoothly close over the top and under the bottom of the cabinet of safe 400 as discussed for safe 200.

Door 432 includes a lock represented by position 433 disposed about midpoint from the top and bottom end of safe 400 to secure door 432 to the safe cabinet for limiting or preventing access to the interior of safe 400 as discussed below.

Door 432 also includes lock cap 435 disposed on trapezoidal door section 432R and 432L as illustrated in FIGS. 9F-9I, 10B & 11A-11C. Lock cap 435 is a cylindrical structure with a hollow interior akin to lock cap 235 (FIG. 5A-5D). Lock cap 435 is disposed on the surface of trapezoidal door section 432R and 432L. The lateral side of lock cap 435 extends perpendicular from the surface of trapezoidal door section 432R and 432L near the edge of openings 432R-O and 432L-O, respectively (FIG. 11C), the hollow interior of each lock cap 235 aligning with openings 432R-O and 432L-O on trapezoidal door section 432R and 432L, respectively (FIG. 11A-11C) so as to receive a lock rod extending through the openings into lock cap 435. Lock cap 435 also includes one or more cutouts on its lateral side through which the lock status of safe 400 can be viewed based the presence of a lock rod in lock cap 435 as discussed above for lock cap 235. In locked position, an end of a lock rod is passed through openings 423O and 432R-O on trapezoidal cabinet section 423 and door section 432R, respectively, into lock cap 435, and the other end of the lock rod is passed through openings 424O and 432L-O on trapezoidal cabinet section 424 and door section 432L, respectively, into lock cap 435, thereby securing door 432 to the cabinet of safe 400.

Door 432 is pivotably connected to the cabinet of safe 400 by continuous hinge 431, which is disposed along the vertical edge of the front door section 432S that is distal to the oblique door section 432Q. As such, door 432 is opened from the oblique side of safe 400, allowing the user access to the interior of safe 400 through the oblique side and enabling access even where door 432 is pivoted to a partly opened position.

The structure of the cabinet of safe 400 includes: (1) horizontally oriented trapezoidal section 423 forming the top or bottom end of the cabinet (not shown); (4) horizontally oriented trapezoidal section 424 (not shown) forming the other end (i.e. top or bottom) of the cabinet; (3) vertically oriented rectangular section 422 forming a first lateral side or side wall of the cabinet; and (4) vertically oriented rectangular section 421 forming a second lateral side or back wall of the cabinet.

Trapezoidal cabinet sections 423 and 424 (FIG. 11A-11C) have structures analogous to trapezoidal door sections 432R and 432L, respectively. Trapezoidal cabinet sections 423 and 424 each includes two parallel edges, a longer and a short parallel edge, as well as an orthogonal edge perpendicularly extending between the parallel edges, and an oblique edge extending between the parallel edges forming angles analogous to angle $\theta_1$ and $\theta_2$ shown in FIGS. 9G and 9I. Trapezoidal cabinet section 423 includes longer parallel edge 423-L, shorter parallel edge 423-S, orthogonal edge 423-P, and oblique edge 423-Q. Similarly, trapezoidal section 424 includes longer parallel edge 424-L, shorter parallel edge 424-S, orthogonal edge 424-P, and oblique edge 424-Q.

Trapezoidal cabinet section 423 also includes opening 423O, and trapezoidal cabinet section 424 includes opening 424O (FIG. 11A-11C). Lock openings 423O and 424O are aligned with lock cap 435 on door sections 432R-O and 432L-O, respectively, to enable a locking rod to pass through openings 423O and 432R-O into lock cap 435 at one end of safe 400 and pass through openings 424O and 432L-O into lock cap 435 at the other end of safe 400 when in locked position.

The shorter parallel edge of each trapezoidal cabinet section and its adjacent, oblique edge define the open front and contiguous open oblique side of the safe cabinet, respectively as described for safe 200 and illustrated in FIGS. 11A-11C. Oblique cabinet edge 423-Q is obtusely angled about 135 degrees relative to shorter parallel cabinet edge 423-S and acutely angled at about 45 degrees relative to longer parallel cabinet edge 423-L. Oblique cabinet edge 424-Q is obtusely angled about 135 degrees relative to shorter parallel cabinet edge 424-S and acutely angled at about 45 degrees relative to longer parallel cabinet edge 424-L. As such, the oblique side of the safe 400 is obtusely angled about 135 degrees relative to front of the cabinet and acutely angled at about 45 degrees relative to back wall of safe 400. The longer parallel edge of each trapezoidal cabinet section and its adjacent orthogonal edge perpendicularly adjoin a horizontal edge of rectangular back wall section 421 and the adjacent horizontal edge of rectangular side wall 422, respectively, as discussed below to form the top or bottom of the safe cabinet.

Each of rectangular sections 421 and 422 includes two parallel vertical edges perpendicular to two parallel horizontal edges (FIG. 9D-9E). Rectangular section 421 includes parallel vertical edges 421-V perpendicular to parallel horizontal edges 421-H. Similarly, rectangular section 422 includes parallel vertical edges 422-V perpendicular to parallel horizontal edges 422-H. A vertical edge 421-V of rectangular section 421 perpendicularly adjoins a vertical edge 422-V of rectangular section 422 to form back wall 421 and adjacent, orthogonal side wall 422 of the cabinet. Back wall 421 and adjacent orthogonal side wall 422 adjoin perpendicularly to form a right angle corner as discussed for safe 200.

Back wall 421 has a shorter length than that of adjacent orthogonal side wall 422. As such, back wall 421 adjoins side wall 422 so horizontal edges of back wall 421 is off set from horizontal edges of side wall 421 resulting in side overhangs extending above and below trapezoidal cabinet top and bottom as discussed for safe 200. The side overhangs allow trapezoidal door sections 432R and 432L to lay flush with the horizontal edge of side wall 422.

In some embodiments, safe 400 is constructed without a face frame. In these embodiments, the cabinet has an open front and contiguous open oblique side that is defined by the shorter parallel edges and adjacent oblique edges of trapezoidal cabinet sections 423 and 424 at the top and bottom and the vertical edges of the side wall and back wall of safe 400. In these embodiments, door 432 is configured to be wider and longer than the cabinet so as to fully overlay the edges of the safe cabinet. As such, the edges of the safe cabinet, as well as the open front and contiguous open oblique side are covered by or hidden behind door 432 when door 432 is closed as illustrated in FIG. 9A.

In other embodiments, safe 400 is constructed with one or more of face frame members 423S, 423Q, 421F, 422F, 424S and 424Q (not shown), analogous to face frame members 123S, 123Q, 121F, 122F, 124S and 124Q of safe 200, respectively. Where safe 400 is constructed with face frame members, door 432 can be configured to be wider and longer than the face frame members so as to fully overlay the face frame members. As such, the face frame members, as well as the open front and contiguous open oblique side of safe 400 are fully covered by or hidden behind door 432 when it is closed as illustrated by FIG. 9A.

Figure 10A:
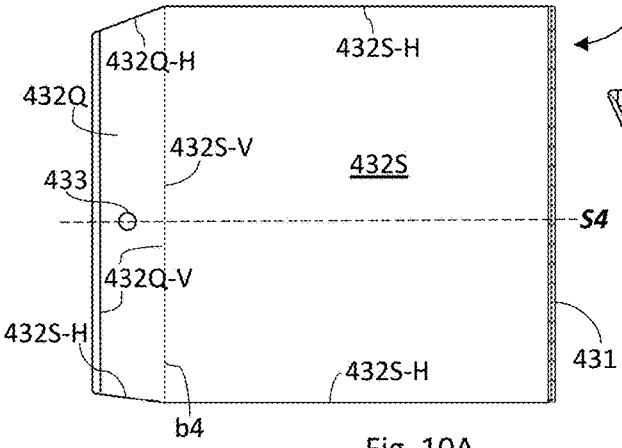
FIGS. 10A-10B are views of safe 400 including: a front side view (FIG. 10A) and a top perspective view from the front (FIG. 10B) when safe 400 is used in an inverted (upside down) position allowing door 432 to open from the left.
Figure 10B:
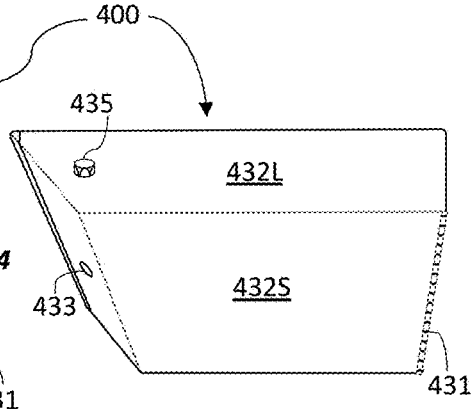

Safe 400 has symmetry about a horizontal plane passing through safe 400 as represented by section line S4 in FIGS. 9A & 10A. As such, safe 400 is invertible and can be utilize in two orientations as illustrated in FIGS. 9A-9C, 9H, & 10A-10B. FIGS. 9A-9C & 9H illustrate orientation R in which the oblique side of safe 400 is on its right allowing the user to open safe 400 and access its interior from the right side of safe 400. In orientation R, trapezoidal door section 432R (FIG. 9G, 11A) overlays trapezoidal cabinet section 423, trapezoidal door section 432R and cabinet section 423 forming the top end of safe 400 as shown in FIGS. 9F and 11A-11B, and trapezoidal door section 432L (FIG. 9I, 11B) extends under trapezoidal cabinet section 424, both of which forming the bottom end of cabinet 400 as shown in FIGS. 9H and 11B. FIGS. 10A & 10B illustrate safe 400 in orientation L in which the oblique side of safe 400 is on its left allowing the user to open safe 400 and access its interior from the left side. In orientation L, trapezoidal door section 432L (FIG. 10B) overlays trapezoidal cabinet section 424, both of which forming the top end of cabinet 400 (FIG. 10B), and trapezoidal door section 432R (FIG. 9G) extends under trapezoidal cabinet section 423, both of which forming the bottom end of cabinet 400.

Example 5

Lock Assembly and Lock Cap

Figure 13A:
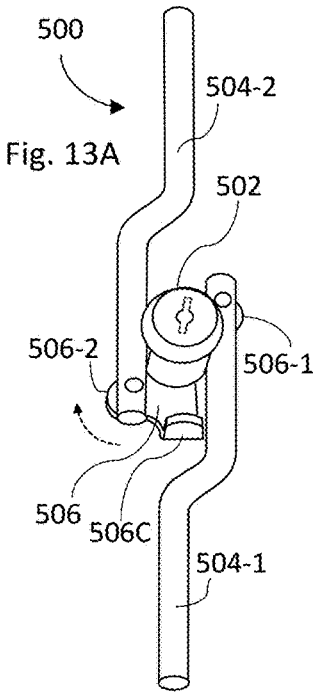
FIGS. 13A-13F are illustrations of lock assembly 500 in the L configuration useful for a safe that opens from the left (13A); a front view of latch 506 of lock assembly 500 (13B); a side perspective view of latch 506 (13C); lock assembly 500 in the R configuration useful for a safe that opens from the right (13D); lower perspective view of lock assembly 500 as viewed through oblique side of door 432, lock assembly 500 being mounted to oblique side 432Q of door 432 and shown in unlocked position (13E); and a lower perspective view of lock assembly 500 as mounted to the oblique side of door 432 (omitted for clarity) and in locked position with respect to cabinet of safe 400 (13F). Door 432, which opens from the left, is omitted for clarity.
Figure 13B:
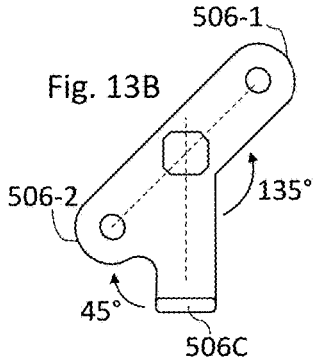
Figure 13C:
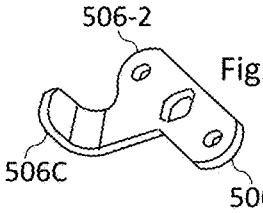

FIGS. 13A-13D illustrate an example of a lock assembly used to secure the door to the cabinet in a safe of the invention. Lock assembly 500 is a three-point lock system that includes: lock cylinder 502C and latch 506 operably connected to lock cylinder 502. Latch 506 has a flat structure with two arms 506-1 and 506-2 that are 180 degrees apart and latch claw 506C about 135 degrees from latch arms 506-1 or 45 degrees from latch arm 506-2 (FIG. 13B). Lock rod 504 is operably secured to each latch arms at a fixed end so that rotary movement of latch 506 about 90 degrees in the direction indicated by the arrow in FIG. 13A causes vertical movement of rods 504 in opposite directions, rod 504-2 moving upward and rod 504-1 moving downward into the lock position. Rotary movement of latch 506 about 90 degrees in the direction indicated by the arrow in FIG. 13A also causes latch claw 506C to rotate to a 9 o'clock locked position (FIG. 13F) from the 6 o'clock unlocked position.

Figure 13D:
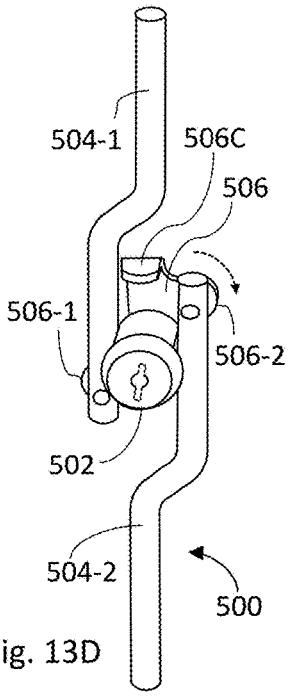

Lock assemble 500 is invertible and can be employed in the orientation illustrated in FIG. 13A, which is useful for a safe that opens from the left, or in inverted 180 degrees as illustrated in FIG. 13D, which is useful for a safe that opens from the right. In FIG. 13D, latch claw 506C is oriented upward in the 12 o'clock unlocked position, and can be set to the 3 o'clock locked position when rotated 90 degrees in the direction indicated by the arrow. Thus, rotary movement of latch 506 about 90 degrees in the direction indicated by the arrow in FIG. 13D causes rod 504-1 to move upward, rod 504-2 to move downward, and latch claw 506C to rotate to a 3 o'clock locked position from the 12 o'clock unlocked position.

Figure 13E:
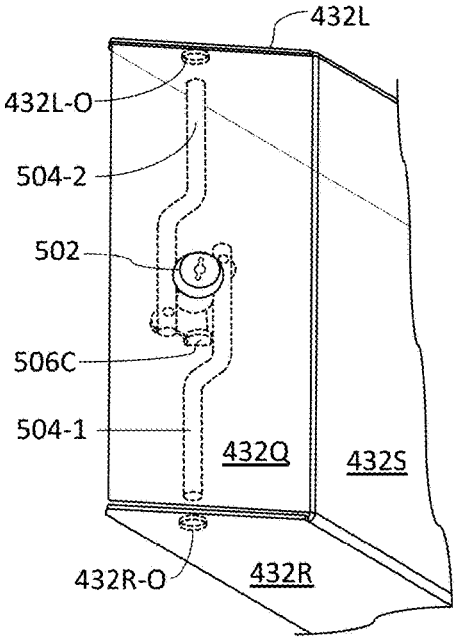

FIG. 13E illustrates lock assembly 500 as mounted on door 432 (safe cabinet omitted for clarity). Lock assembly 500 is mounted on oblique door section 432Q, lock cylinder 502C passing through oblique door section 432Q at a position about mid-way from trapezoidal top 432L and trapezoidal bottom 432R. Thus, lock face with key opening 502 is visible from the exterior of safe 400. Lock assembly 500 is in an unlock position as indicated by lock claw 506C being directed downward at the 6 o'clock position (or 12 o'clock position in the R configuration), and lock rod 504-1 and 504-2 being retracted within door 432. In the unlocked position, the free end of rod 504-2 is below opening 432L-O of trapezoidal door section 432L, and the free end rod 504-1 is above opening 432R-O. When in the unlocked position, the free end of rod 504-2 is also below opening 424-O of trapezoidal cabinet section 424 (not shown), and the free end rod 504-1 is also above opening 423-O of trapezoidal cabinet section 423 (not shown) to allow door 432 with mounted lock assembly 500 to open.

Figure 13F:
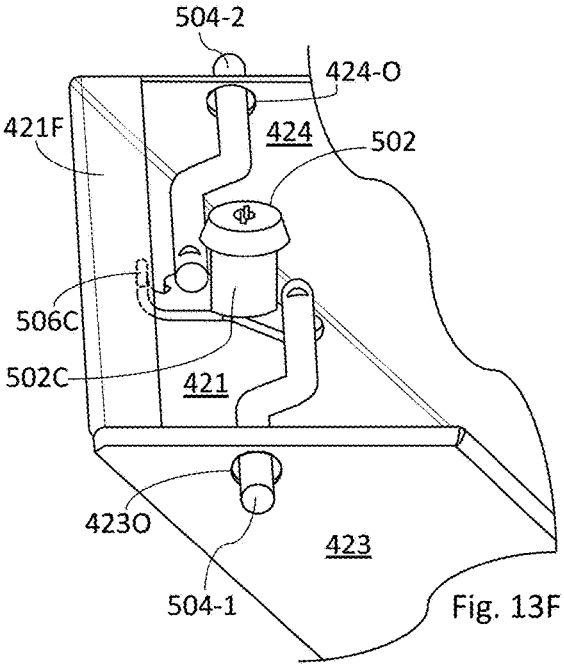

FIG. 13F illustrates lock assembly 500 in locked position as engaged with the cabinet of safe 400. The free end of rod 504-2 passes through opening 424-O of trapezoidal cabinet section 424 on one end of safe 400, and the free end of rod 504-1 passes through opening 423-O of trapezoidal cabinet section 423 on the other end of safe 400. The free ends of rod 504-2 and 504-1 also pass through openings 432L-O and 432R-O on trapezoidal door sections 432L and 432R, respectively, above and below cabinet openings 424O and 423O, respectively, as cabinet openings 424O and 423O are aligned with door openings 432L-O and 432R-O when safe door is closed. Door 432 on which lock assembly 500 is mounted is omitted for clarity in FIG. 13F.

FIG. 13E also illustrates the 9 o'clock position of latch claw 506C when safe assembly 500 is in the locked position in the L configuration. Latch claw 506C rotates to a position behind cabinet frame 421F thereby holding cabinet frame 421F to oblique door section 432Q. As lock assembly 500 is mounted to door 432 (through oblique door section 432Q), rotation of latch claw 506C to a position behind cabinet frame 421 prevents separation of door 432 from cabinet frame 421F thereby securing door 432 to cabinet of safe 400.

Figure 14A:
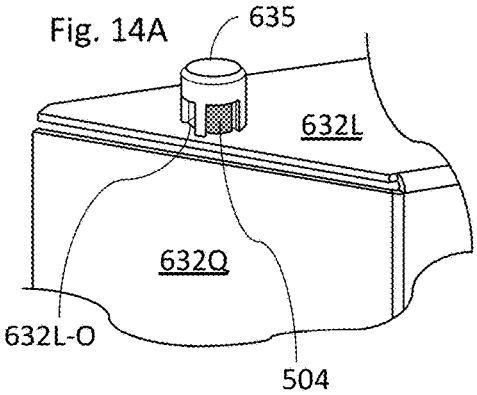
FIGS. 14A-14C are illustrations of two embodiments of a lock cap of the invention including: a side perspective view of cylindrical lock cap 635 on trapezoidal top section 632L of safe 600 (14A), a side perspective view of box-shaped lock cap 735 on trapezoidal door section 732L of safe 700 (14B); and a front view of lock cap 735 on trapezoidal door section 732L, the front and oblique side of door 732S and 732Q are omitted for clarity (14C).
Figure 14B:
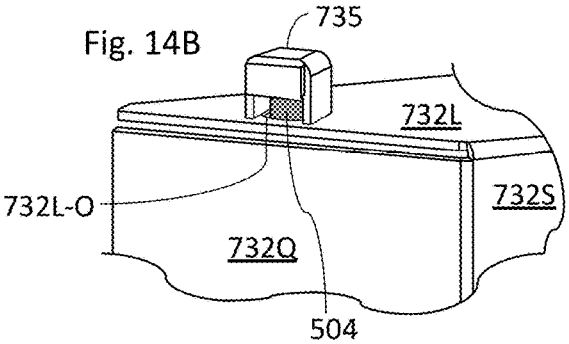
Figure 14C:
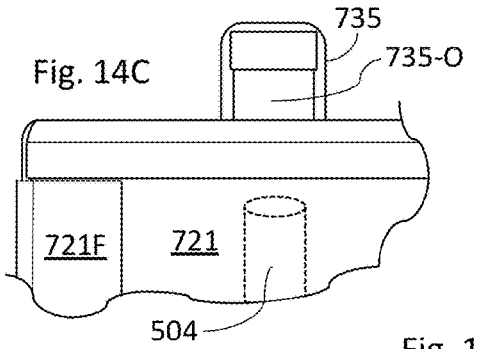
Figure 15:
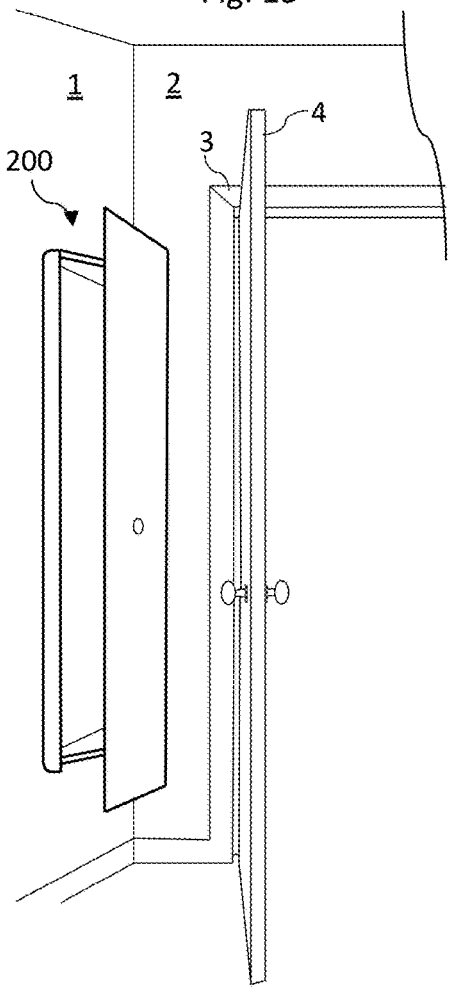
FIG. 15 is a schematic diagram providing a perspective view of safe 200 as mounted on wall 1 and with its door partly opened.

In some embodiments of the invention, a safe of the invention includes a lock cap disposed on the trapezoidal door sections as illustrated in FIGS. 14A-14C. FIG. 14A illustrates cylindrical lock cap 635 with two lateral openings through which the presence of lock rod 504 is visible when door 632 is secured to the cabinet of safe 600. FIG. 14B illustrates box-shape lock cap 735 with two openings through which the presence of lock rod 504 is visible thereby indicating door 732 is secured to cabinet of safe 700. FIG. 14C illustrates the would-be position of lock rod 504, i.e. a retracted position beneath lock cap 735, behind door section 732Q (not shown) when lock assembly 500 is in an unlocked position.

Other Embodiments of the Invention

The terms and expressions used herein are terms of description and not of limitation. There is no intent in the use of such terms and expressions to exclude any equivalent of the features shown and described or portions thereof. In addition, modification and variation of the concepts herein disclosed may be resorted to by those skilled in the art, and such modifications and variations are considered to be within the scope of this invention as defined by the appended claims. While the invention has been described in conjunction with the detailed description, the foregoing description is intended to illustrate and not limit the scope of the invention defined by the scope of the claims. Other aspects, advantages, and modifications are within the scope of the following claims. In addition, the invention has been described broadly and generically herein. Each of the narrower species and subgeneric groupings falling within the generic disclosure also form part of the invention. As used herein and in the appended claims, the singular forms "a," "an," and "the" include plural reference unless the context clearly dictates otherwise.

What is claimed is:

1. A modified box-shape safe comprising an oblique side, the safe comprising:

(a) a modified box-shaped cabinet for holding an article that comprises a rectangular back wall, a rectangular side wall, and congruent trapezoidal top and bottom walls defining an open front and contiguous open oblique side obtusely angled relative to the open front; and (b) a door that comprises a rectangular front section adjoining a rectangular oblique side section obtusely angled relative to the front section, the door being configured to close the open front and contiguous open oblique side of the cabinet to form a closed chamber; the door being hinged to the cabinet so as to enable the door to open from the oblique side.

2. The safe of claim 1, wherein:

(a) the rectangular side wall comprises a first vertical edge that perpendicularly adjoins a vertical edge of the back wall thereby forming an orthogonal side wall; and (b) the trapezoidal top and bottom wall each comprises a longer and a shorter parallel edge, an orthogonal edge extending perpendicularly between the parallel edges on one side, and an oblique edge extending obliquely between the parallel edges on the other side, wherein the longer parallel edge and orthogonal edge perpendicularly adjoin a horizontal edge of the back wall and an adjacent horizontal edge of the orthogonal side wall, respectively.

3. The safe of claim 2, wherein the front section of the door is wider than the oblique side section of the door.

4. The safe of claim 3, wherein front section of the door adjoins the oblique side section of the door at an angle between about 120 degrees to about 150 degrees.

5. The safe of claim 2, wherein the orthogonal side wall is about 2 inches to about 7 inches wide.

6. The safe of claim 2, wherein the back wall comprises vertical and horizontal edges of the same lengths thereby forming a square back wall.

7. The safe of claim 2, wherein the back wall comprises vertical edges having greater lengths than the lengths of the horizontal edges thereby forming a safe that is taller than it is wide.

8. The safe of claim 2, wherein the back wall comprises vertical edges of shorter lengths than the lengths of the horizontal edges thereby forming a safe that is wider than it is tall.

9. The safe of claim 2, wherein the cabinet further comprises a face frame surrounding the open front and contiguous open oblique side of the cabinet, the face frame comprising:

(a) a first and a second horizontal frame member, each comprising a front portion that perpendicularly adjoins the shorter parallel edge of the trapezoidal top and bottom wall and an oblique portion that perpendicularly adjoins the oblique edge of the trapezoidal top and bottom wall; and (b) a first and a second vertical frame member that perpendicularly adjoin a vertical edge of the back wall and orthogonal side wall, respectively.

10. The safe of claim 9, wherein the cabinet further comprises two horizontally oriented inner lock flanges, each perpendicularly adjoining at least the oblique portion of one of the horizontal frame members, and the safe door further comprising two horizontally oriented inner lock flanges, each perpendicularly adjoining a horizontal edge of at least the oblique side of the door, one door lock flange extending beneath one of the two cabinet lock flanges to form the top lock flanges, and the other door lock flange overlaying the other of the two cabinet lock flanges to form the bottom lock flanges when the door is closed;

wherein the top and bottom lock flanges each comprises a lock opening disposed adjacent the oblique side of the cabinet and door, respectively; and wherein the lock openings on the top lock flanges are vertically aligned to receive a lock rod extending through the aligned lock openings at the top, and the lock openings on the bottom lock flanges are vertically aligned to receive second lock rod extending through the aligned lock openings at the bottom when the door is closed.

11. The safe of claim 9, wherein the door is hinged to the vertical frame member that adjoins the orthogonal side wall of the cabinet.

12. The safe of claim 2, wherein the door further comprises a top and a bottom section, each horizontally oriented to extend over the top or under the bottom of at least a portion of the top or bottom wall of the cabinet when the door is pivoted to close the cabinet.

13. The safe of claim 12, wherein the top and bottom sections of the door each comprises a congruent right trapezoidal section substantially similar to the trapezoidal top and bottom walls of the cabinet, each trapezoidal section of the door comprising a longer and a shorter parallel edge, an orthogonal edge extending perpendicularly between the parallel edges, and an oblique edge extending between the parallel edges and obtusely angled relative to the shorter parallel edge, wherein the shorter parallel edge and the oblique edge of each trapezoidal door section perpendicularly adjoin adjacent horizontal edges of the front section and oblique side section of the door, respectively.

14. The safe of claim 13, wherein each of the trapezoidal top and bottom wall of the cabinet perpendicularly adjoins the orthogonal side wall of the cabinet at a position off set from a horizontal edge of the orthogonal side wall so as to form a top and bottom orthogonal side overhang enabling the top and bottom trapezoidal door sections to lay flush against the orthogonal side wall of the safe when the door is closed.

15. The safe of claim 13, wherein each of the trapezoidal top and bottom wall of the cabinet and each of the trapezoidal top and bottom section of the door comprises a lock opening size to accommodate a lock rod for securing the door to the cabinet, wherein the lock opening on the top wall of the cabinet and the lock opening on the top section of the door are vertically aligned when the door is closed so as to accommodate a first lock rod extending through the aligned lock openings at the top, and wherein the lock opening on the bottom wall of the cabinet and the lock opening on the bottom section of the door are vertically aligned when the door is closed so as to accommodate a second lock rod extending through the aligned lock openings at the bottom.

16. The safe of claim 15, wherein the trapezoidal top or bottom section of the door further comprises a lock cap at the lock opening on the trapezoidal top or bottom, the lock cap comprising a hollow interior configured to accommodate a portion of the lock rod extending through the aligned lock openings, the lock cap further comprising one or more lateral openings through which the presence of the lock rod extending through the aligned lock opening can be seen.

17. The safe of claim 1, which comprises a two or three point lock assembly comprising two vertically oriented lock rods configured to move vertically in opposite directions through operation of the lock assembly.

18. The safe of claim 1, wherein the back wall of the cabinet comprises one or more openings through which the safe is mounted to a wall.

19. The safe of claim 1, wherein the cabinet back wall, side wall, trapezoidal top wall, trapezoidal bottom wall, safe door, or any combination thereof comprises steel.

20. The safe of claim 1, wherein the door is hinged to the cabinet using a continuous hinge.

21. The safe of claim 1, which is configured to be mountable on a wall of a room through the rectangular back wall, the rectangular back wall interfacing with the wall of the room when the safe is mounted on the wall of the room.

22. The safe of claim 1, which is invertible.

* * * * *